US009768567B2

(12) United States Patent
Cheng et al.

(10) Patent No.: US 9,768,567 B2
(45) **Date of Patent: *Sep. 19, 2017**

(54) FLIPPABLE ELECTRICAL CONNECTOR

(71) Applicant: FOXCONN INTERCONNECT TECHNOLOGY LIMITED, Grand Cayman (KY)

(72) Inventors: Chih-Pi Cheng, New Taipei (TW); Wen He, Shenzhen (CN); Quan Wang, Shenzhen (CN); Chao-Chieh Chen, New Taipei (TW); Yue Zhou, Shenzhen (CN); Feng Zeng, Shenzhen (CN); Lu Dai, Kunshan (CN); Hao Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 15/394,839

(22) Filed: Dec. 30, 2016

(65) Prior Publication Data

US 2017/0194755 A1 Jul. 6, 2017

(30) Foreign Application Priority Data

Dec. 31, 2015 (CN) ..... 2015 1 1014128
Jan. 8, 2016 (CN) ..... 2016 2 0014087 U
(Continued)

(51) Int. Cl.
*H01R 24/00* (2011.01)
*H01R 24/60* (2011.01)
(Continued)

(52) U.S. Cl.
CPC ..... *H01R 24/60* (2013.01); *H01R 12/7082* (2013.01); *H01R 12/75* (2013.01); *H01R 2107/00* (2013.01)

(58) Field of Classification Search
CPC .. H01R 13/405; H01R 24/60; H01R 2107/00; H01R 23/7073; H01R 23/7005
(Continued)

(56) References Cited

U.S. PATENT DOCUMENTS 8,851,927 B2 * 10/2014 Hsu ..... H01R 12/724 439/607.11
9,214,766 B1 * 12/2015 Yu ..... H01R 13/6585
(Continued)

OTHER PUBLICATIONS

Universal Serial Bus Type-C Cable and Connector Specification Revision 1.0 Aug. 11, 2014, p. 18-19,28-48,51,55,58,59-63,65-67,70,93,96-99.107,110-113.

*Primary Examiner* — Phuongchi T Nguyen
(74) *Attorney, Agent, or Firm* — Wei Te Chung; Ming Chieh Chang

(57) ABSTRACT

An electrical connector assembly includes a housing comprising a rear base and a mating tongue extending forward from the base; a row of upper terminals and a row of lower terminals retained on the housing, each terminal including a contacting section exposed to mating tongue and a pin leg section from the base, and the contacting sections of the upper and lower terminals being aligned with each in a vertical direction. The contacting sections of each row terminals are arranged in different central pitch, the pin leg sections of the upper and lower terminals are aligned with each in a front and back direction and the pin leg sections of each row are arranged with a same central pitch.

7 Claims, 35 Drawing Sheets

(30) Foreign Application Priority Data

Jan. 22, 2016 (CN) ..... 2016 1 0041598
Jan. 28, 2016 (CN) ..... 2016 2 0082112 U

(51) Int. Cl.
*H01R 12/70* (2011.01)
*H01R 12/75* (2011.01)
*H01R 107/00* (2006.01)

(58) Field of Classification Search
USPC ..... 439/660, 626, 374, 377, 79, 733
See application file for complete search history.

(56) References Cited

U.S. PATENT DOCUMENTS 9,318,856 B2 * 4/2016 MacDougall ..... H01R 13/6581
9,502,827 B2 * 11/2016 Feng ..... H01R 13/6581
9,564,716 B2 * 2/2017 Kao ..... H01R 13/6586

* cited by examiner

| | | | |
|---|---|---|---|
| A12 | GND | | B1 |
| A11 | PCIE_TX+ | | B2 |
| A10 | PCIE_TX- | | B3 |
| A9 | 3DG_VSYNG_IN | | B4 |
| A8 | BT_REG_ON | | B5 |
| A7 | BT_USB- | | B6 |
| A6 | BT_USB+ | | B7 |
| A5 | NC/TBD | | B8 |
| A4 | VBAT | | B9 |
| A3 | BT_HOST_WAKE | | B10 |
| A2 | WL_HOST_WAKE | | B11 |
| A1 | GND | | B12 |

FIG. 23

FLIPPABLE ELECTRICAL CONNECTOR

BACKGROUND OF THE INVENTION

1. Field of the Invention

The present invention relates generally to an electrical connector, especially to an USB-Type C receptacle and plug.

2. Description of Related Arts

USB Implementers Forum issues a new specification which establishes a new type connector named as USB Type-C Cable and Connector, on Aug. 11, 2014. In the specification, the Type-C plug enhances ease of use by being plug-able in either upside-up or upside-down directions. The receptacle connector has more elements and has smaller, thinner size. Because of the number of terminals of the USB Type-C connector is large, the manufacturing process thereof is complicated and the cost is high.

Hence, a new and simple electrical connector and method of manufacturing the same is desired to improve those disclosed in the aforementioned proposal.

SUMMARY OF THE INVENTION

Accordingly, the object of the present invention is to provide an electrical connector assembly comprises: a housing comprising a rear base and a mating tongue extending forward from the base; a row of upper terminals and a row of lower terminals retained on the housing, each terminal comprising a contacting section exposed to mating tongue and a pin leg section from the base, and the contacting sections of the upper and lower terminals being aligned with each in a vertical direction; wherein the contacting sections of each row terminals are arranged in different central pitch, the pin leg sections of the upper and lower terminals are aligned with each in a front and back direction and the pin leg sections of each row are arranged with a same central pitch.

Accordingly, the another object of the present invention is to provide a printed circuit board (PCB) defining a top surface on which the electrical connector is mounted and a lower surface. The PCB comprises a row of first holes to receive the pin leg sections of the upper terminals and a row of second holes to receive the pin leg sections of lower terminals along a front and back direction, the corresponding first and second holes being aligned with each other in the front and rear direction; each row of the first and second holes consists of a grounding hole, a power holes, four signal holes, a power holes, and a grounding hole in sequence. Each of first holes is connecting with an extending trace on the top surface to a system, each of the grounding holes and power holes of the first holes are further connected with corresponding the corresponding hole of the second holes with a connecting trace on the top surface. A first signal hole and a fourth signal hole of the second holes each is connected with an extending trace on the lower surface to the system; a second signal hole of the first holes is connected with the a third signal holes of the second holes with a connecting trace on one of the top and lower surface, a third signal holes of the first holes is connected with a second signal holes of the second hole with a connecting trace on another of the top and lower surface.

According to the present invention, the electrical connector of the invention is simple in process, so that it can effectively reduce the manufacturing cost.

BRIEF DESCRIPTION OF THE DRAWING

FIG. 23 is a table shown the terminals' assignment of the receptacle connector;

DETAILED DESCRIPTION OF THE PREFERRED EMBODIMENT

While the depicted embodiments may be susceptible to embodiment in different forms, there is shown in the Figures, and will be described herein in detail, specific embodiments, with the understanding that the present disclosure is to be considered an exemplification of certain principles and is not intended to limit the Present Disclosure to that which is illustrated.

FIG. 1 to FIG. 7 illustrate a receptacle connector of a first embodiment, FIG. 9 to FIG. 16 illustrate a receptacle connector of a second embodiment, FIG. 17 to FIG. 24 to illustrate a receptacle connector and a plug connector of a third embodiment, FIG. 25 to FIG. 35 illustrate a plug connector of a fourth embodiment. Please notes, the same or similar elements are identically numbered and similar constructions and functions are omitted.

Figure 1:
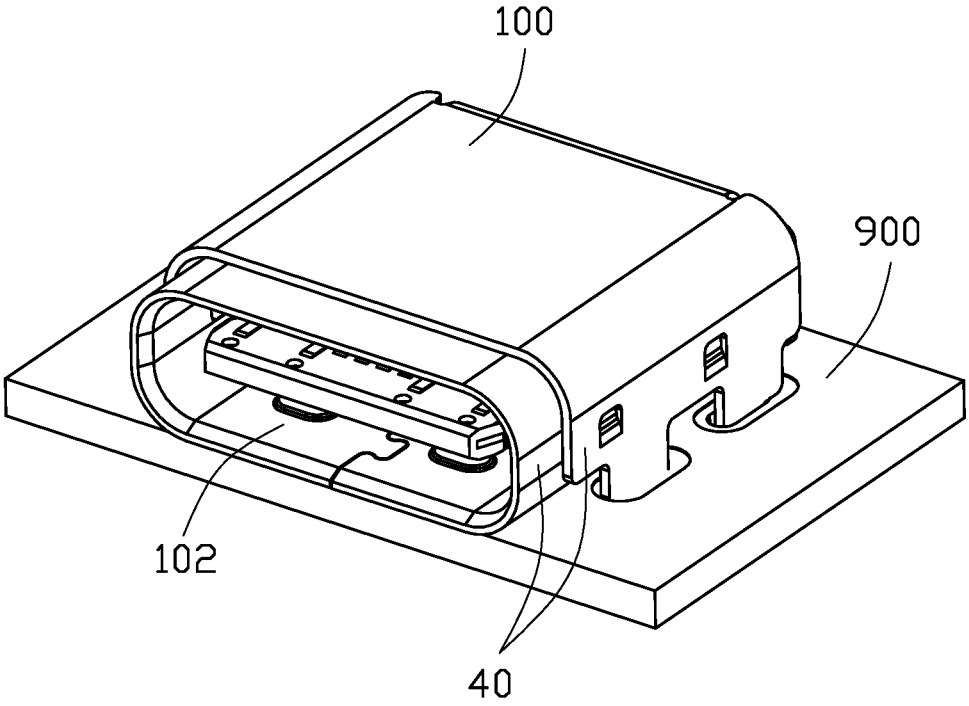
FIG. 1 is a front and top perspective view of an electrical connector mounted on a PCB of a first embodiment made in accordance with the present invention.
Figure 2:
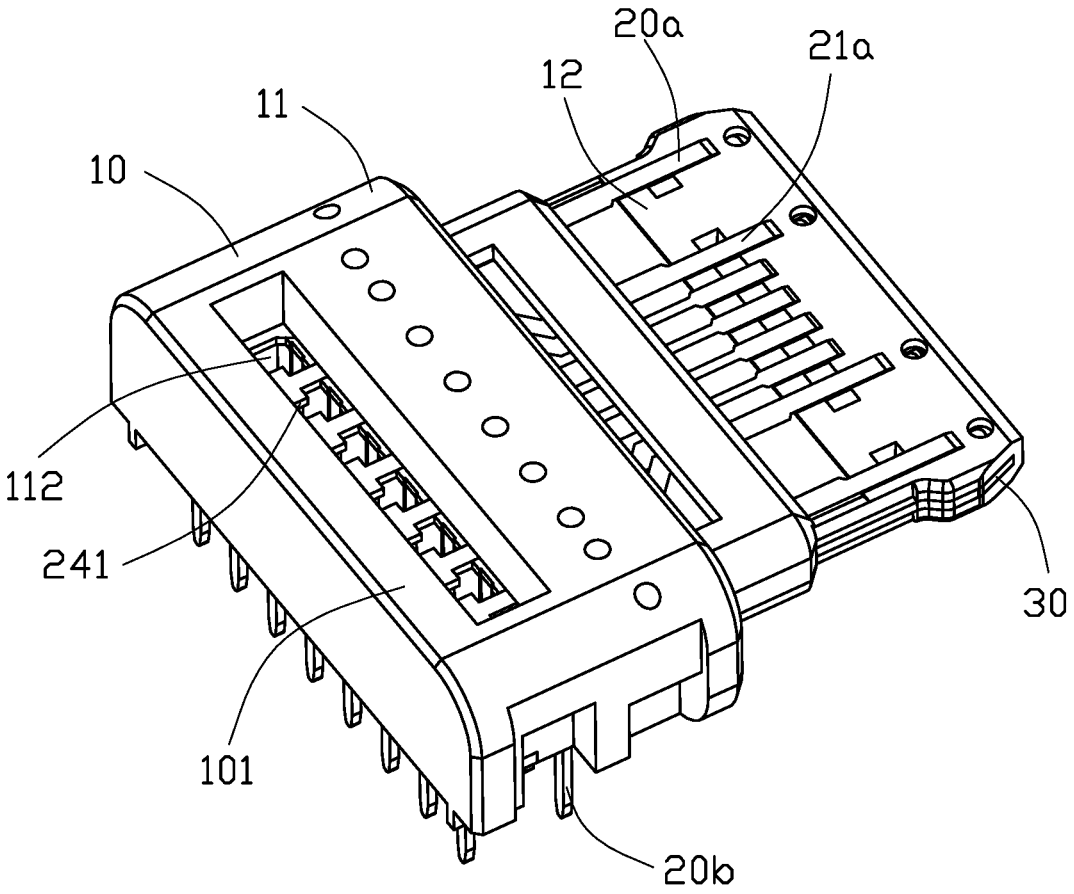
FIG. 2 is a top and rear perspective view of the electrical connector with the shielding shell taken away shown in FIG. 1.

Referring to FIG. 1 to FIG. 7, the receptacle connector 100 of the first embodiment of the present disclosure is illustrated. Referring to FIGS. 1 and 2, the receptacle connector 100 is mounted on a circuit printed board (PCB) 900, which is used to transmit USB 2.0 signal and power. The receptacle 100 includes an insulative housing 10 including a rear base 11 and a mating tongue 12 extending forward from the base 10, and two rows of terminals 20 (including a row of upper terminals 20*a* and a row of lower terminals 20*b*) retained in the housing 10. The insulating housing 10 defines an upper surface 101 and a lower surface (not labeled) opposite to the upper surface, which two extend in the base 11 and mating tongue 12. A metallic shielding shell 40 is retained around the base 11 and surrounds the mating tongue 12 so as to define a mating cavity 102 among the shell 40 and the mating tongue 12. The mating cavity 102 is defined opening forwardly for insertion of a mating electrical plug connector (not shown). The terminals 20 of each row are arranged in a transverse direction, each terminal extends in a front and rear direction. Combination with FIG. 5, a shielding plate 30 is located between and isolates the two rows of the terminals 20.

Figure 3:
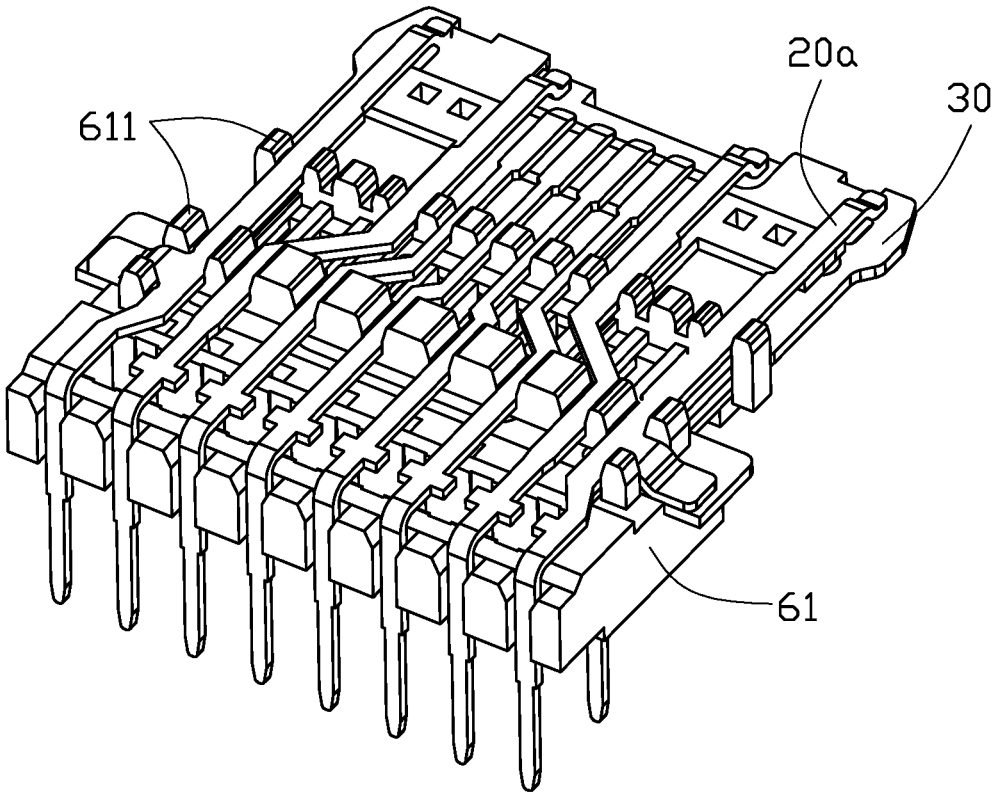
FIG. 3 is a top and rear perspective view of terminal module with upper terminals shown in FIG. 2.
Figure 4:
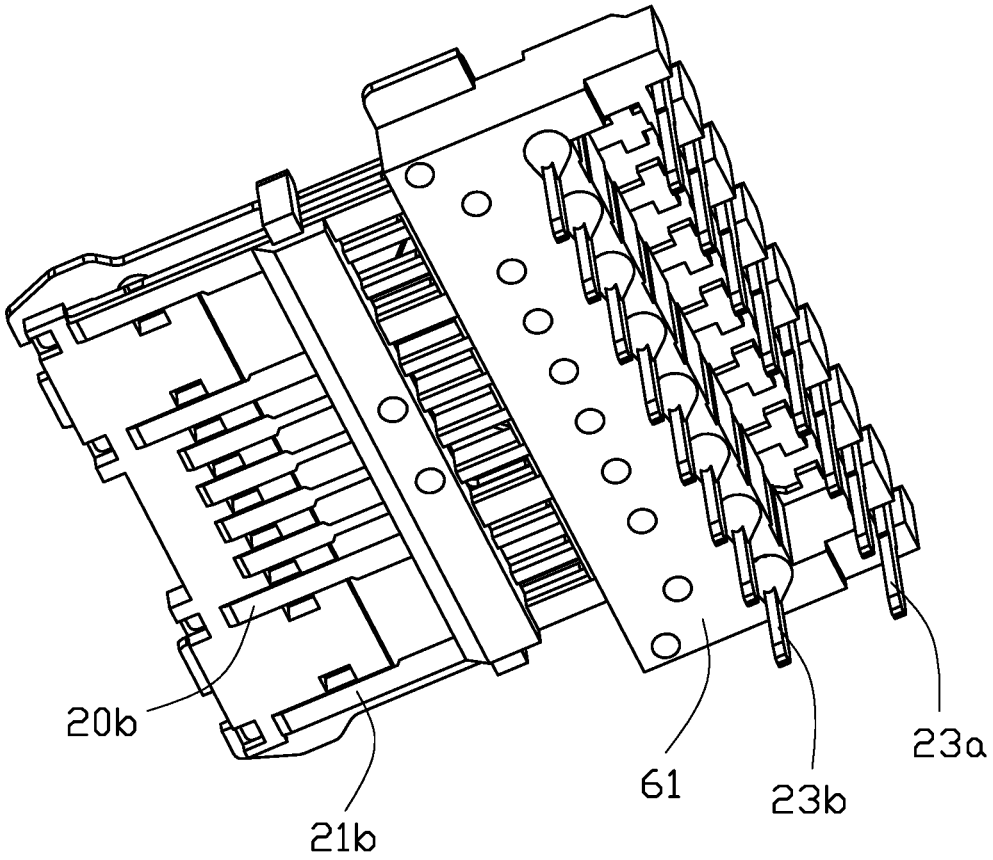
FIG. 4 is a bottom view of the terminal module shown in FIG. 3.

Referring to FIGS. 3 and 4, the shielding plate 30 and the row of lower terminals 20*b* are inserting-molded with injecting molten plastic to form a lower module 61, wherein the lower module 61 defines portioned ribs 611 on a top surface thereof. Then the row of upper terminals 20*a* are disposed on the top surface of the lower module 61 and primarily positioned by the partitioned ribs 611. The lower module 61 with the upper terminals 20*a* is inserting-molded with injecting molten plastic, thereby forming the completed insulating housing 10 loaded with the terminals 20*a*, 20*b* and the shielding plate 30.

Figure 5:
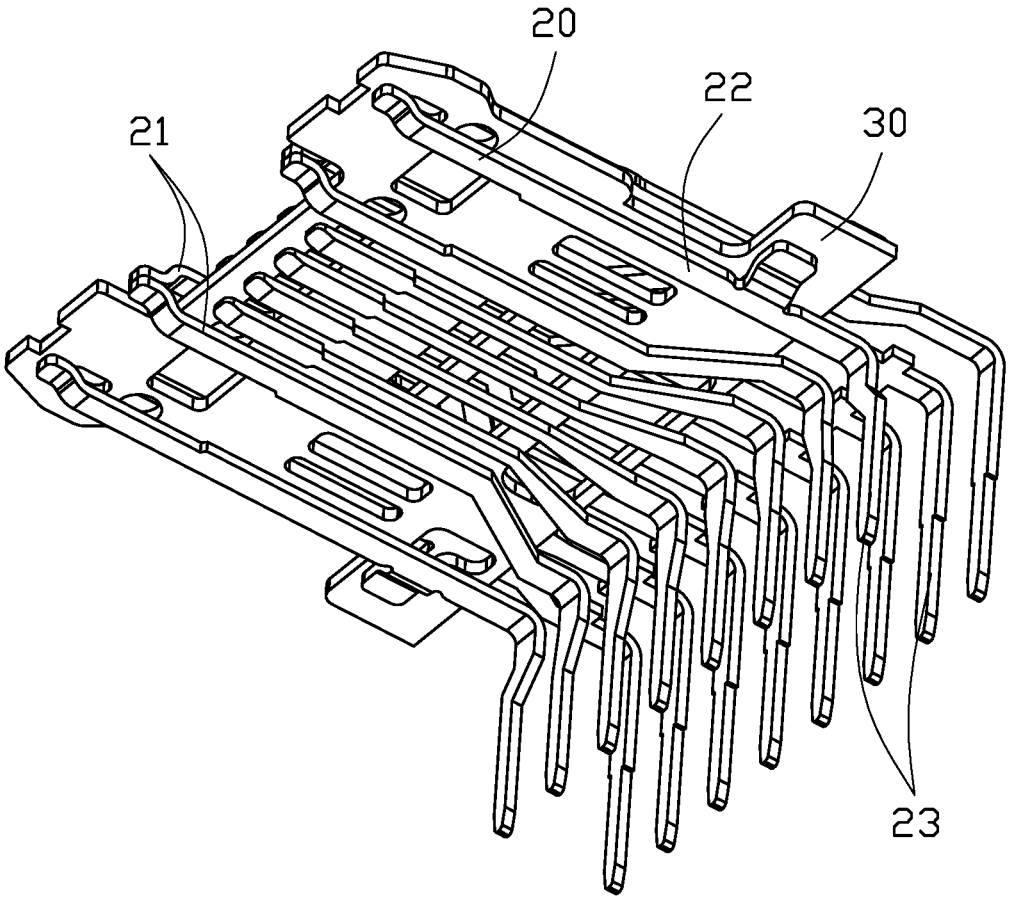
FIG. 5 is a perspective view of two rows of terminals and a shielding shell shown in FIG. 2.

Combination with FIG. 5, each of the terminals 20 includes a contacting section 21 exposing to the opposite surfaces of the mating tongue 12, a middle section 22 embedded in the housing 10, and a leg section 23 bending downward from the middle section 22. During the second inserting-molded process, the adjacent middle sections 22 of the upper terminals 20*a* are laterally connected with each other by a bridge section (not shown in the first embodiment and it can be seen in FIG. 18) and after then the bridge sections are cut away. The bridge sections not only facilities automatically manufacture, but also help for retaining the upper terminals 20*a* in predetermined positions even in shock of a flow of the insulating material during the second inserting-molded process. Combination with FIG. 2, the base 11 defines a slot 112 through the top surface 101 and the lower surface thereof and the bridge sections are exposed to the slot 112. After cutting the bridge section, the middle section 22 is remained with wing sections 241. That is to say, the receptacle connector 100 includes wing sections 241 exposing to the slot 112. The leg sections 23*a*, 23*b* of the upper and lower terminals through-hole types are arranged in one row and located at two opposite side of the slot 112.

Figure 6:
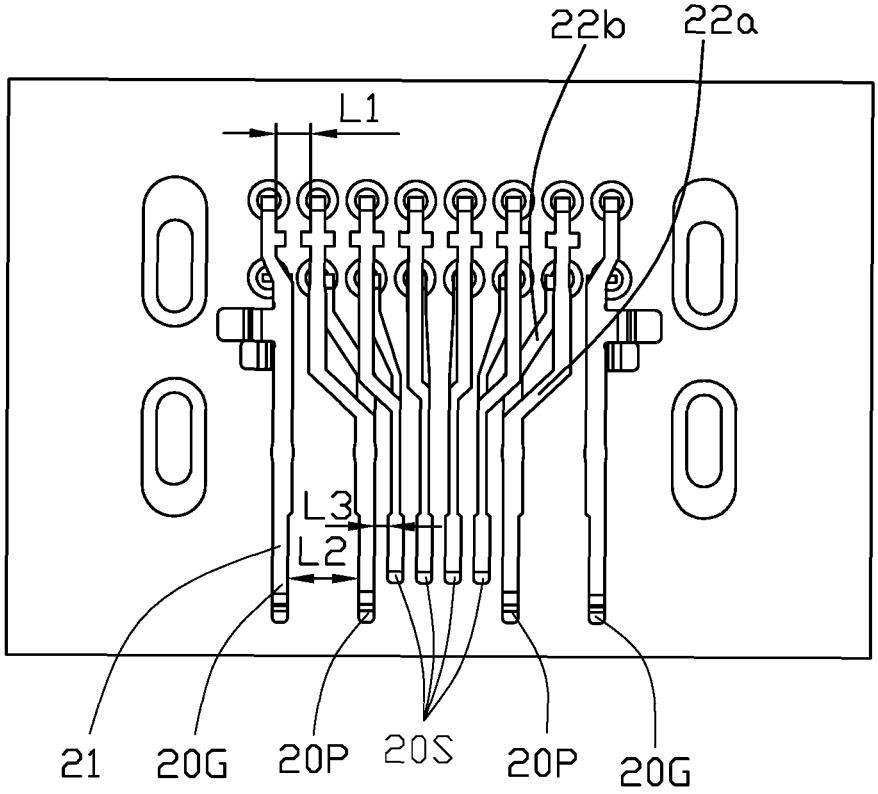
FIG. 6 is a top plan view of the two rows of terminals mounted on the PCB.

The receptacle connector 100 is in accordance with the specification of a type-C USB connection interface with twenty four terminals in two rows but taken away four pair of differential signal terminals. Referring to FIG. 6, each row of the lower and upper terminals consists of a grounding terminal 20G a power terminal 20P, four signal terminals 20S, a grounding terminal 20G a power terminal 20P in subsequence, without any high frequent differential pair signal terminals. The contacting sections 21 are aligned with each other in a vertical direction, the middle sections 22*a*, 22*b* of the power terminals 20P and signal terminals 20S are divided into two groups and the two groups are offset oppositely along the transverse direction so that the leg sections 23 of the first and second terminals are aligned with each other in the front and rear direction.

As shown in FIG. 6, every two adjacent leg portions 23 of the terminals in each row has a distance L1, a distance L2 is disposed between the adjacent grounding terminal and the power terminal at the contacting sections 21, a distance L3 is disposed between the adjacent power terminal and the signal terminal or between every two adjacent the signal terminals at contacting sections 21. The distance L1 is larger than the distance L3 while smaller than the distance L1 (L3<L1<L2).

In the other way, the mating tongue 12 which is compliance with USB Type C pin assignment is pre-arranged with twenty terminal locations with a same central pitch. Therefore, the middle six terminals 20P, 20S, 20P have a same first central pitch, the contacting sections 21 of the grounding terminal 20G and power terminal 20P has triple first central pitch, the leg sections 23 has a second central pitch larger than the first central pitch.

Figure 7:
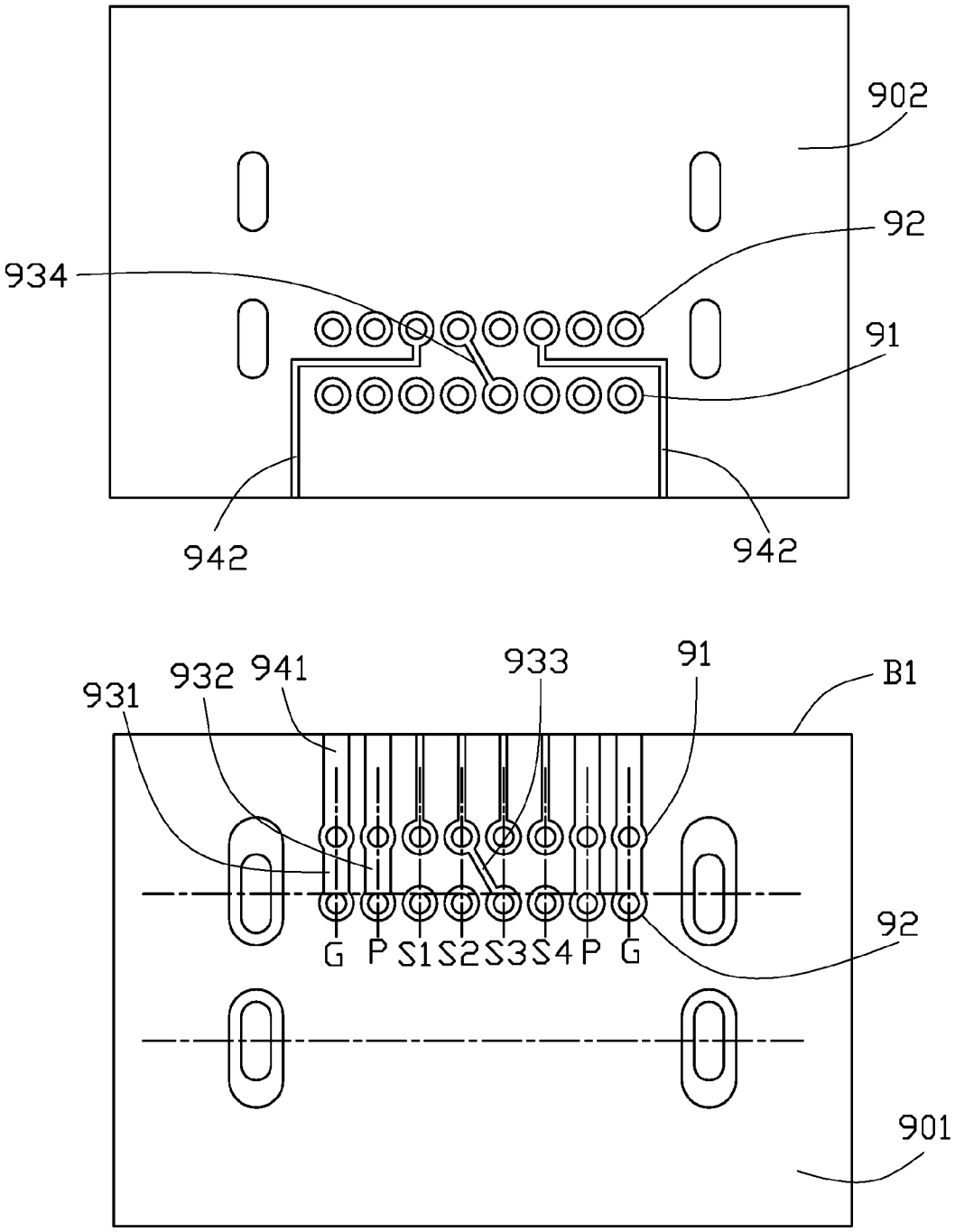
FIG. 7 is a sketch view of the top surface and the lower surface of the PCB.
Figure 8:
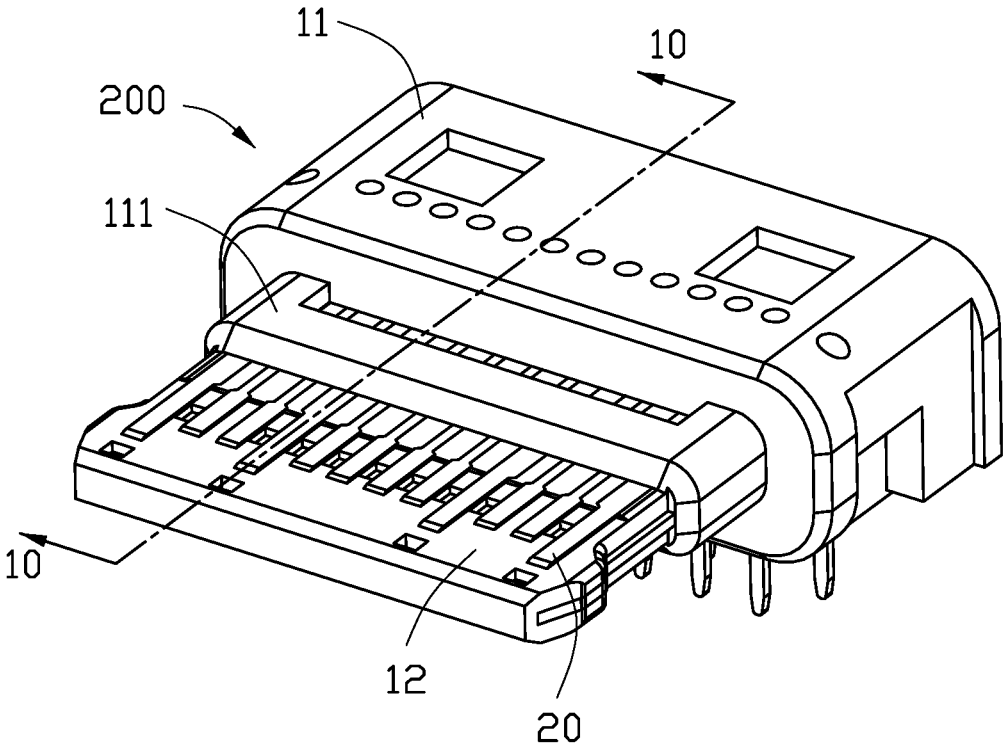
FIG. 8 is a front and top perspective view of an electrical connector with the shielding shell taken away of a second embodiment made in accordance with the present invention.
Figure 9:
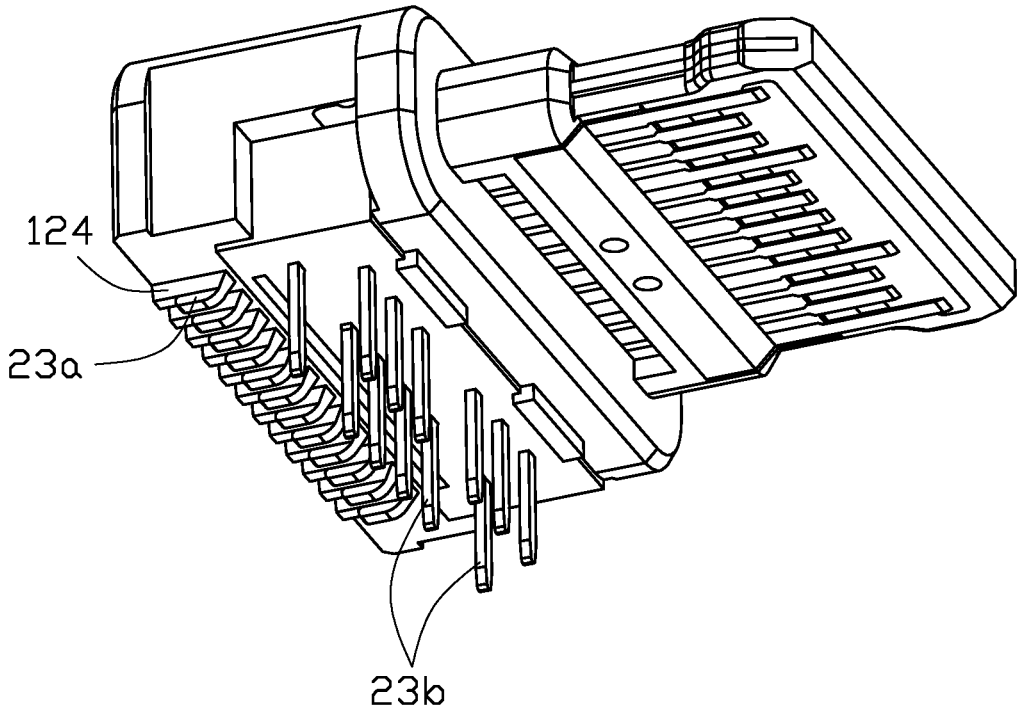
FIG. 9 is a bottom perspective view of the electrical connector in FIG. 8.
Figure 10:
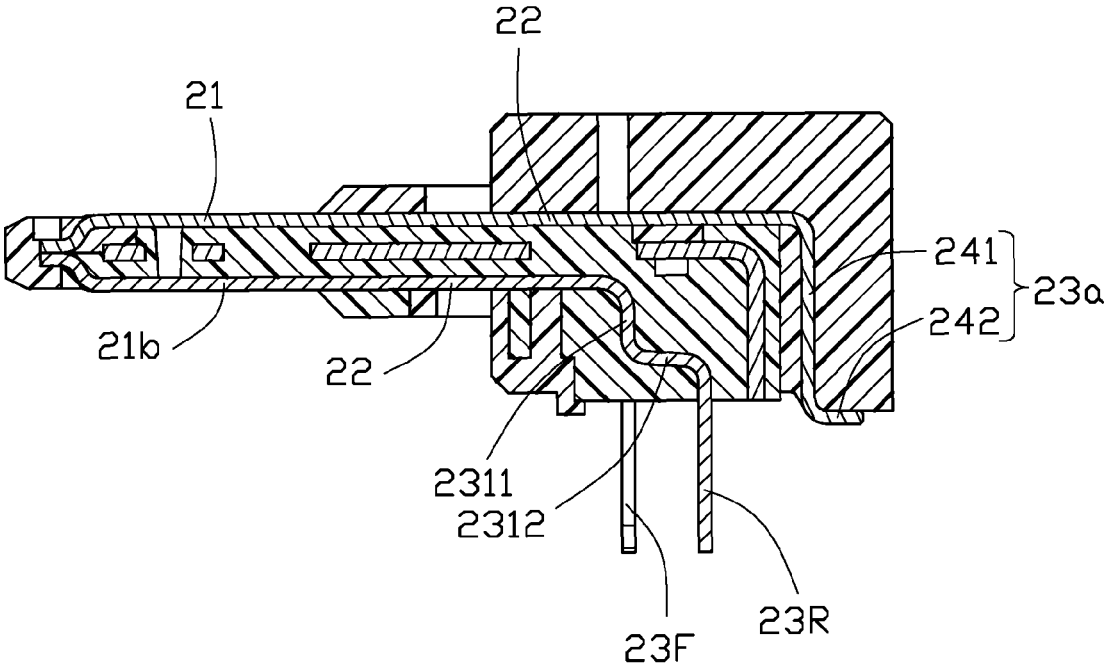
FIG. 10 is a cross-sectional view of the electrical connector taken along line 10-10 in FIG. 8.
Figure 11:
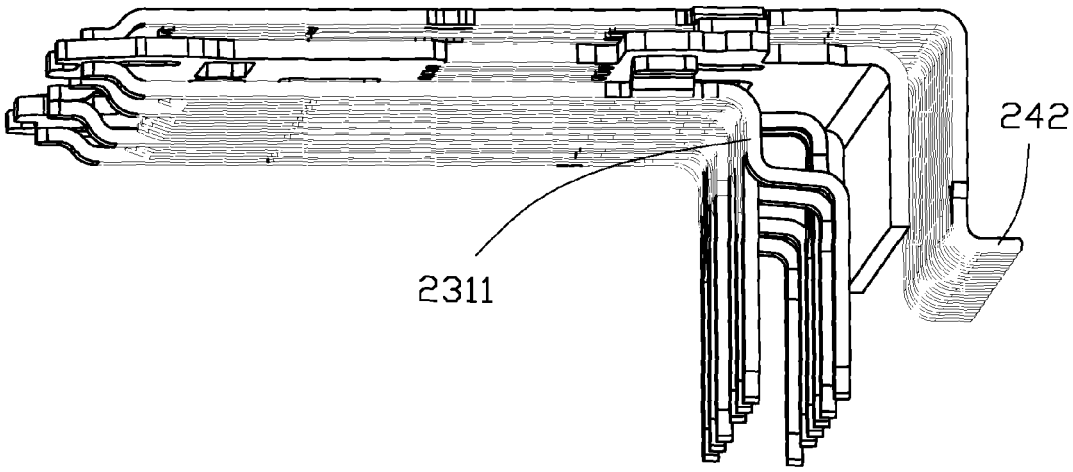
FIG. 11 is a perspective view of the two rows of terminals and the shielding plate shown in FIG. 8.
Figure 12:
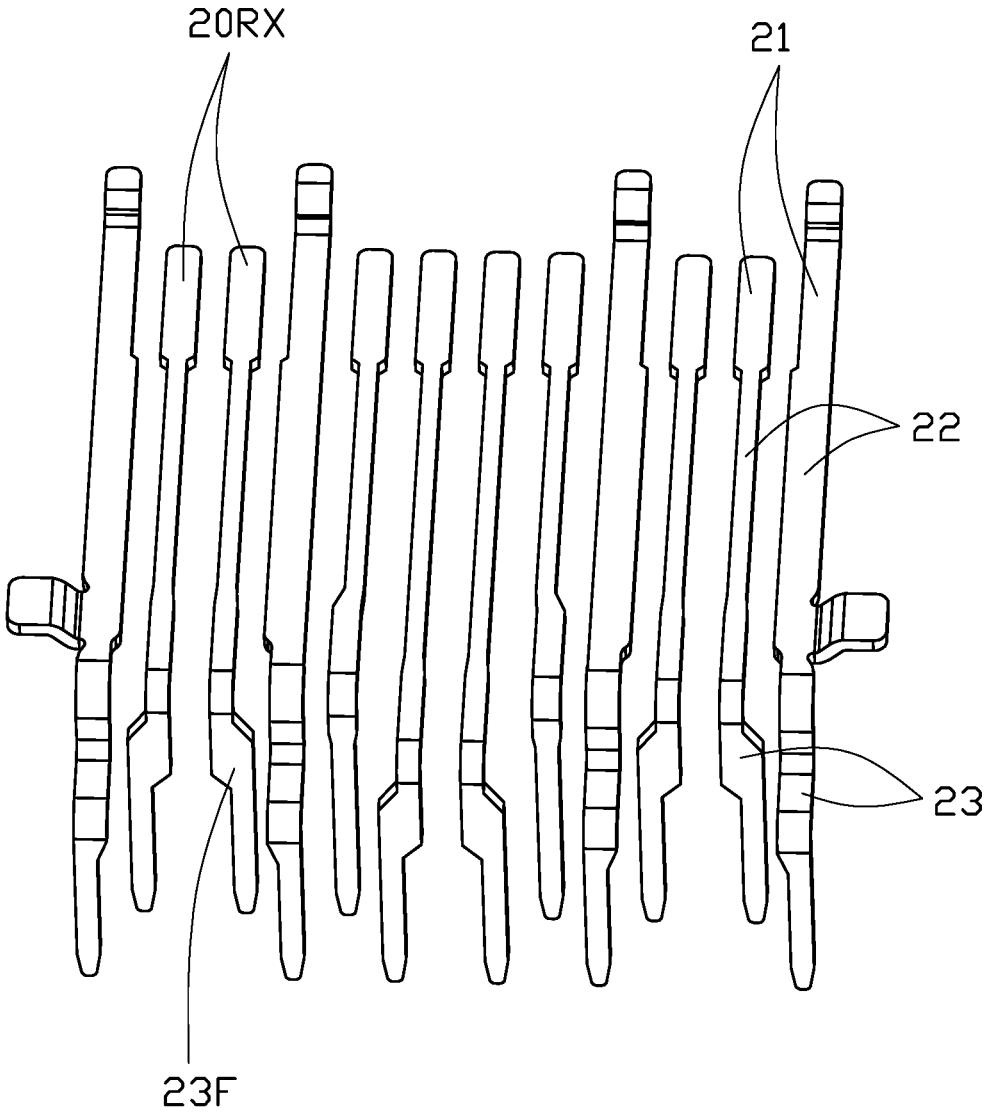
FIG. 12 is a rear perspective view of the row of lower terminals shown in FIG. 11.
Figure 13:
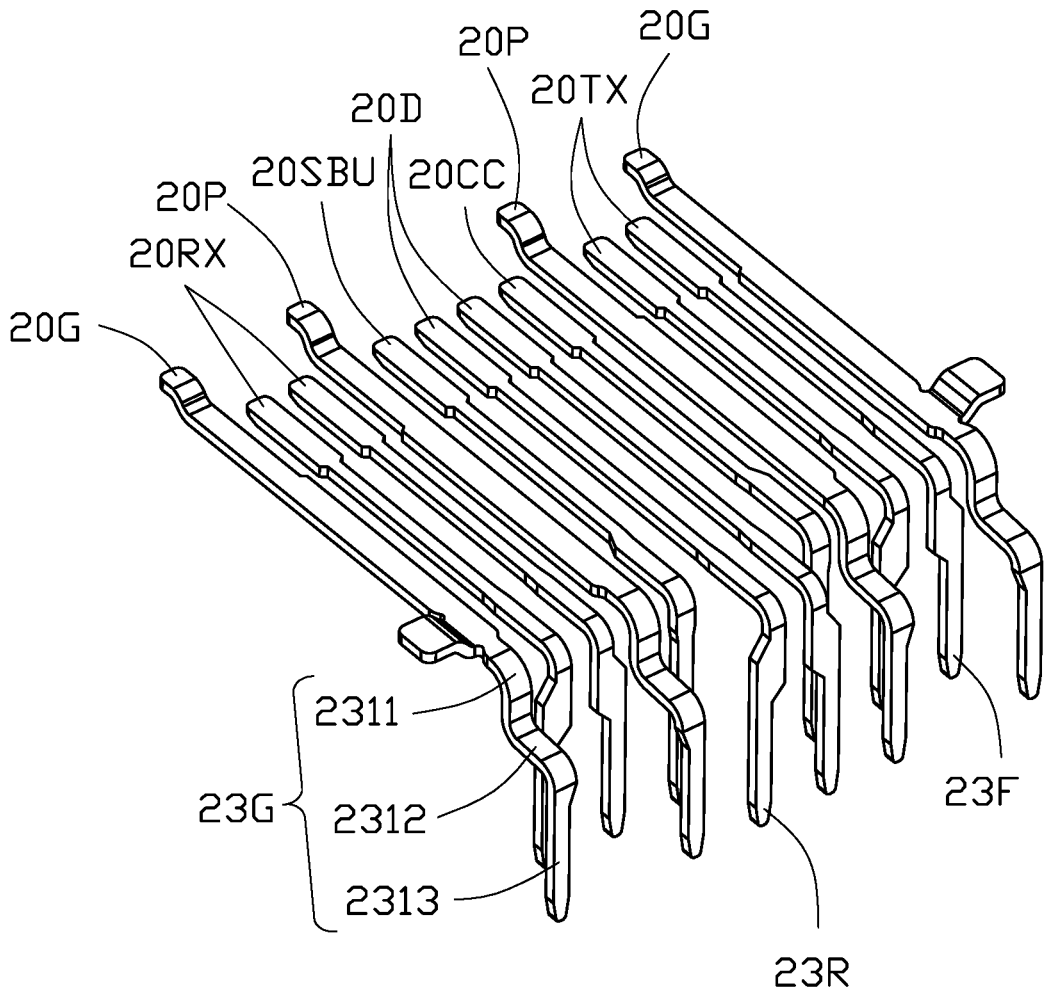
FIG. 13 is an another perspective view of the row of lower terminals as shown in FIG. 12.
Figure 14:
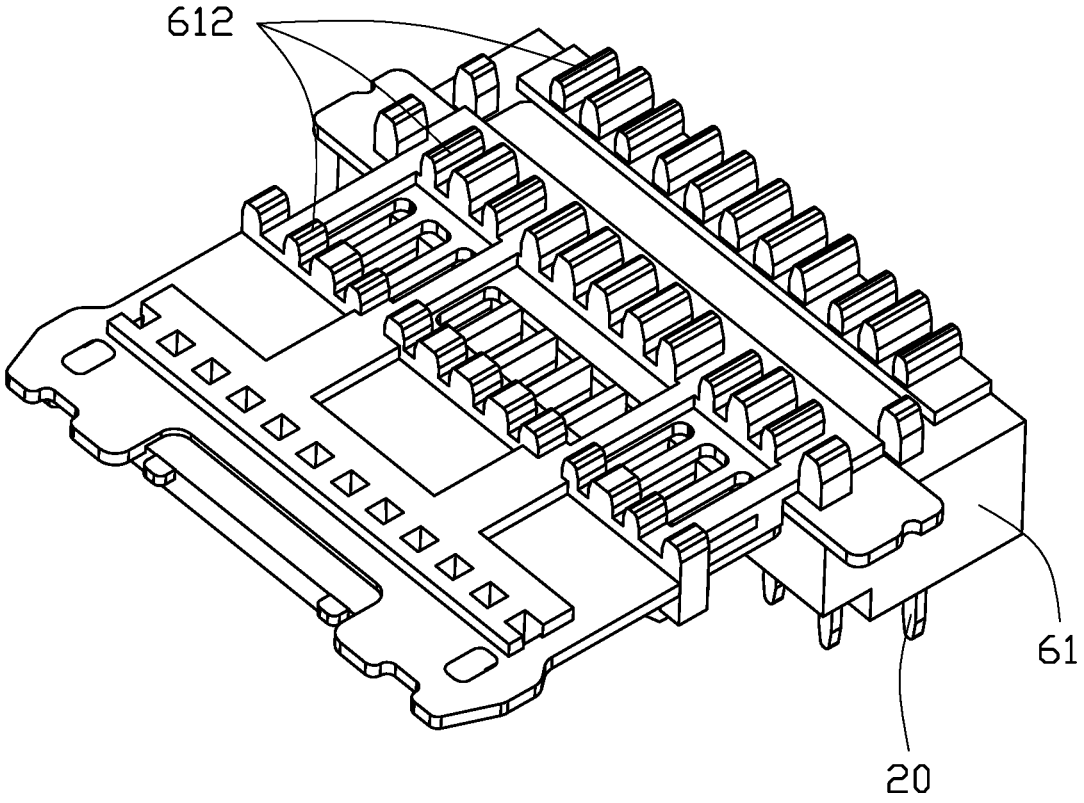
FIG. 14 is a top perspective view of the terminal module.
Figure 15:
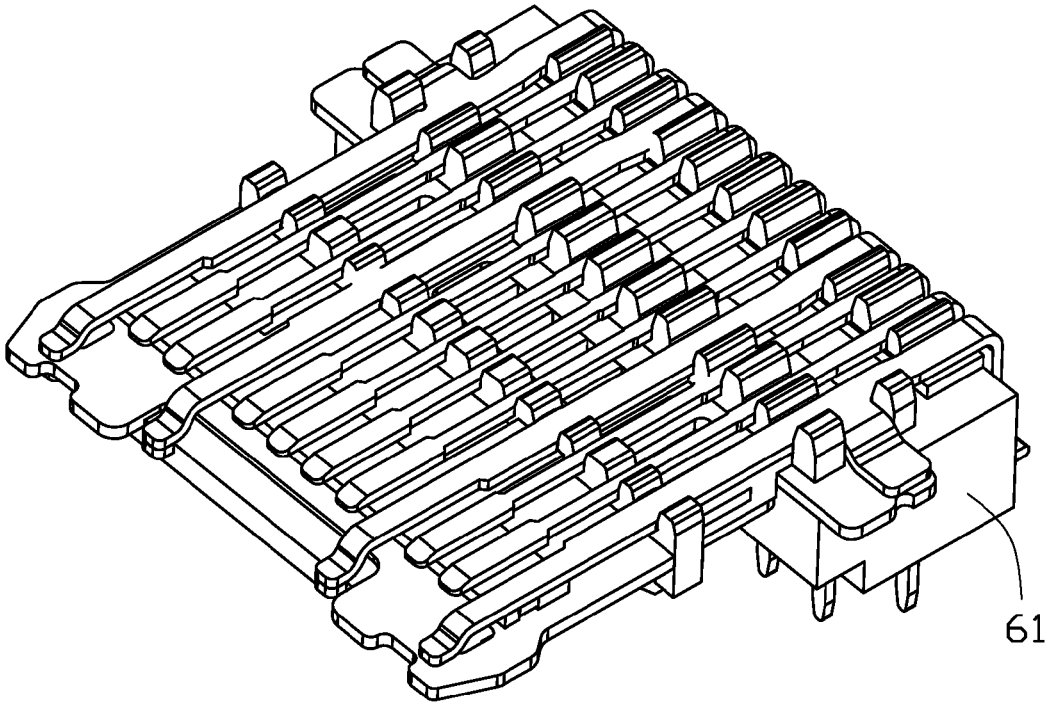
FIG. 15 is a top perspective view of the terminal module with the upper terminals.
Figure 16:
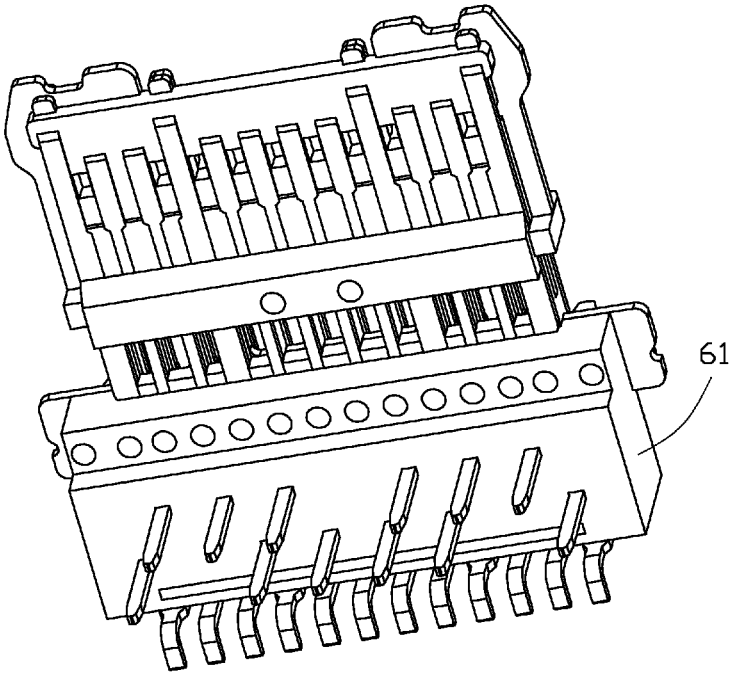
FIG. 16 is a bottom perspective view of the terminal module with the upper terminals as shown in FIG. 15.

Referring to FIG. 7 showing an upper surface 901 and a lower surface 902 of the PCB 900 wherein the receptacle connector 100 is mounted on the top surface 901 of the PCB. The PCB 900 defines a row of first holes 91 nearby a rear edge B1 of the PCB 100 for the leg sections 23*a* of the upper terminals 20*a*, and a row of second holes 92 behind the first holes 91 for the leg section 23*b* of the lower terminals 20*b*.

Corresponding to the leg section 23*a*, 23*b*, each of the first and second holes consist of a grounding hole G, a power hole P, four signal holes S1-S4, a power hole P, a grounding hole G in sequence. The first and second holes 91, 92 are aligned with each other in a front and rear direction. Every two grounding holes G aligned with each other in the front and rear direction of the first and second holes are connecting with each other by a first connecting trace 931. Every two power holes P aligned with each other in the front and rear direction of the first and second holes are connecting with each other by a second connecting trace 932. The second signal hole S2 of the first holes 91 is connected with the third holes S3 of the second holes with a third connecting trace 933. The third signal hole S3 of the first holes 91 is connected with the second holes S2 of the third holes with a fourth connecting trace 934. The first, second and third trace are set in the upper surface 901 of the PCB, and the fourth trace 934 are set in the lower surface 902 of the PCB. Each first hole 91 is connecting with an extending trace 941 set in the upper surface 901 of the PCB to system, the second holes are firstly connecting to the first holes through the connecting trance and then electrically connect to the system except the first and fourth second holes S1, S4. The signal holes S1, S4 are connecting with an second extending trace 942 set in the lower surface 901 of the PCB to the system, The second extending traces 942 connecting with the first and fourth signal holes S1, S4 respectively, go through gaps between the first and second holes. Therefore, occupying area of the receptacle connector 100 on the PCB will decrease and sampling trace on the PCB will get.

That is to say, each of first holes 91 is connecting with an extending trace 941 on the top surface to a system, each of the grounding holes and power holes of the first holes are further connected with corresponding the corresponding hole of the second holes with a connecting trace 931/932 on the top surface; a first signal hole and a fourth signal hole of the second holes each is connected with an extending trace 942 on the lower surface to the system; a second signal hole of the first holes is connected with the a third signal holes of the second holes with a connecting trace 933 on one of the top and lower surface, a third signal holes of the first holes is connected with a second signal holes of the second hole with a connecting trace 934 on another of the top and lower surface of the PCB.

Referring to FIG. 8 to FIG. 16, an electrical connector 200 in the second embodiment of the present disclosure is illustrated, which is USB Type C receptacle and similar to the connector 100 in the first embodiment. Specifically, the electrical connector 200 is a high frequent receptacle connector and has twenty four terminals 20 along the mating tongue 12, which is also named as a full featured connector compared to the receptacle connector 100 in the first embodiment where four pairs of deferential signal pair are taken away. The mating tongue 12 has a thicken step 111 at a root thereof near the base portion 11. The leg portions 23*a* of the upper terminals in a SMT type are arranged in a pad row, each of which is supported by a standup rib 124, and the leg portions 20*b* of the lower terminals are in a pin shape or through hole type and arranged in two rows. The lower module 61 has three columns of positioning rib 612 for preliminarily retaining the upper terminals 20*a*.

Each leg section 23*a* of the upper terminal includes a vertical connecting portion 241 and a horizontal portion 242 perpendicularly bending from the connecting portion. All of leg portions 23*a* are aligned with each other in the transverse direction and are arranged in a straight line.

There are three types of the leg portions 23*b* of the lower terminals 20*b*. Of some lower terminals 20*b* of a first type, each of leg portions 23F are in a vertical pin shape and all those leg portions are arranged in a front row. Of some lower terminals 20*b* of a second type, each of leg portions 23R are in a vertical pin shape and all those leg portions 23R are arranged in a middle row behind the front row and in front of the pad row. Of some lower terminals 20*b* of a third type, the leg section 23 further are constructed with a vertical portion 2311, a horizontal portion 2312 bending from the vertical portion and a vertical soldering portion 2313 bending from horizontal portion 2312. The vertical portion 2311 are disposed to be line up with the leg portions 23F, the vertical soldering portion are disposed to be line up with the leg portion 23R.

In the preferred embodiment, the high frequent differential pair terminals 20RX, 20TX, the detecting terminals 20SBU, 20CC have the pin leg portions 23F in the front row, the USB 2.0 terminals 20D have the pin leg portion in 23R, the grounding terminal 20G and the power terminals 20P have the curved leg portions 23G. The high speed performance of the high frequent differential pair terminals are further improved by the vertical portion 2311 of the grounding and power terminals located at opposite sides of the leg portions 23F of the high frequent different pair terminals.

Referring to FIG. 17 through FIG. 24, the connector assembly including a customized receptacle connector 300 intended to be mounted on a PCB and a customized plug connector 500 intending to connect with cable, of the third embodiment of the present disclosure is illustrated.

Figure 17:
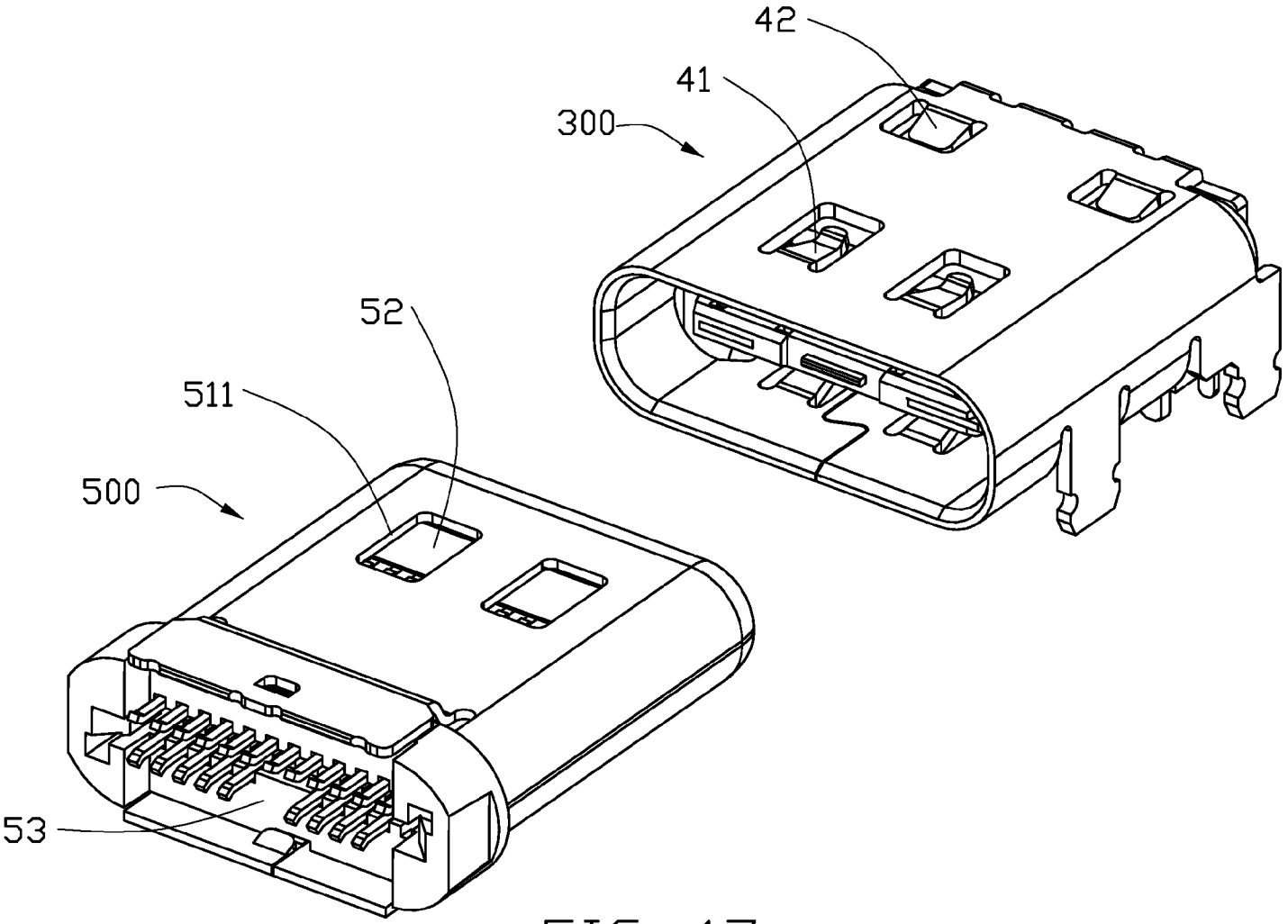
FIG. 17 is a perspective view of a receptacle connector and a plug connector in an un-mating statute of a third embodiment made in accordance with the present invention.
Figure 18:
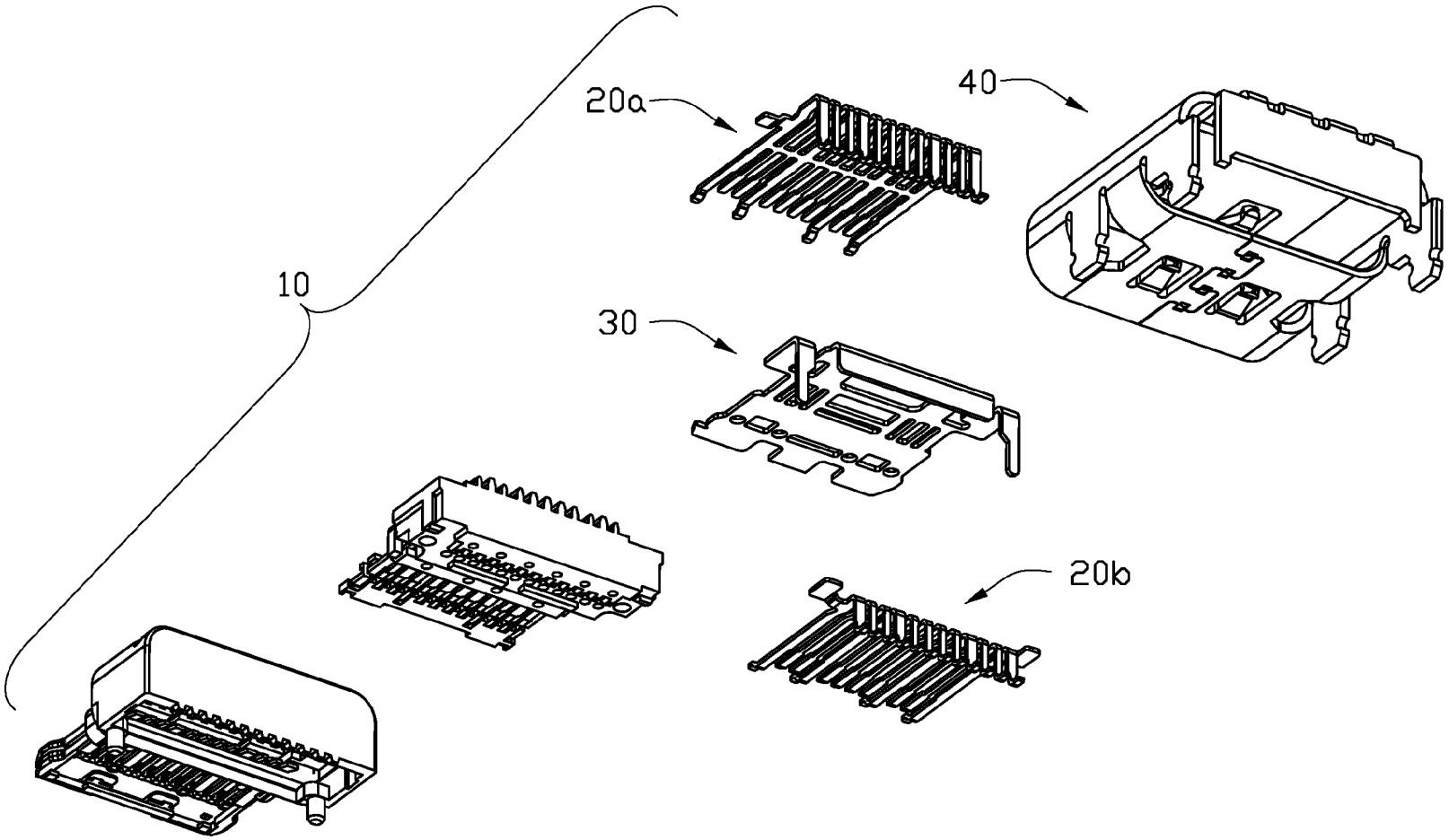
FIG. 18 is an exploded perspective view of the receptacle connector as shown in FIG. 15.
Figure 19:
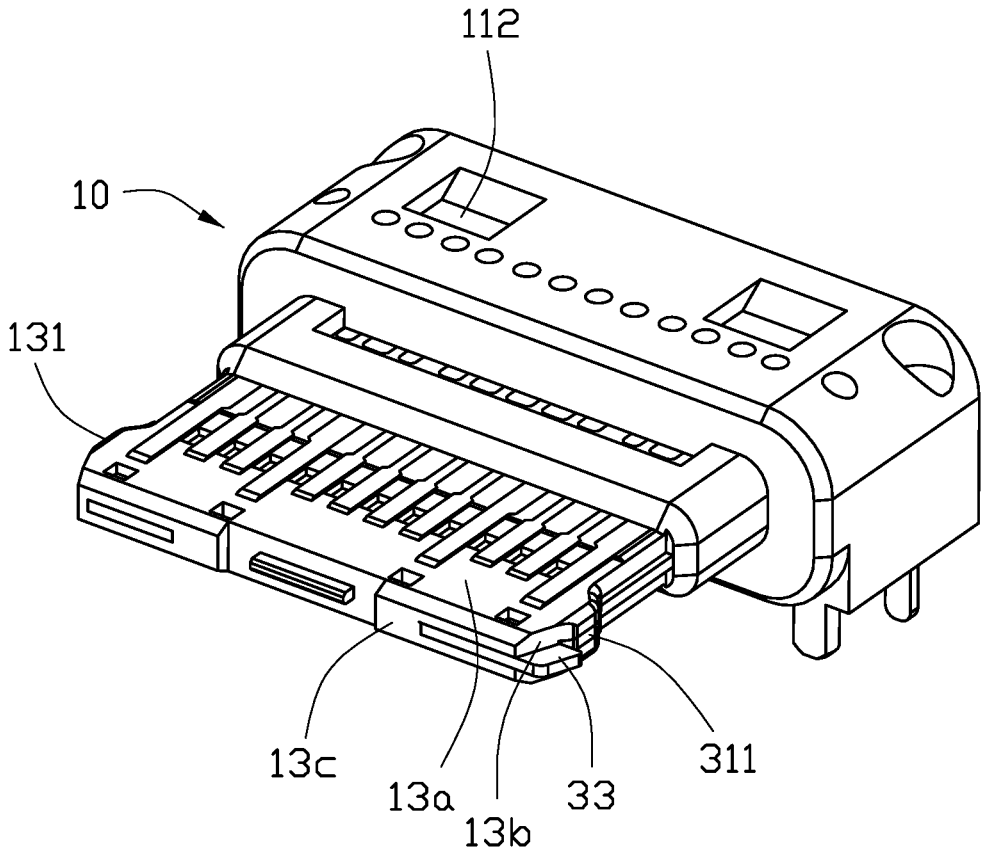
FIG. 19 is a top perspective view of the receptacle connector with the shielding shell taken away as shown in FIG. 18.
Figure 20:
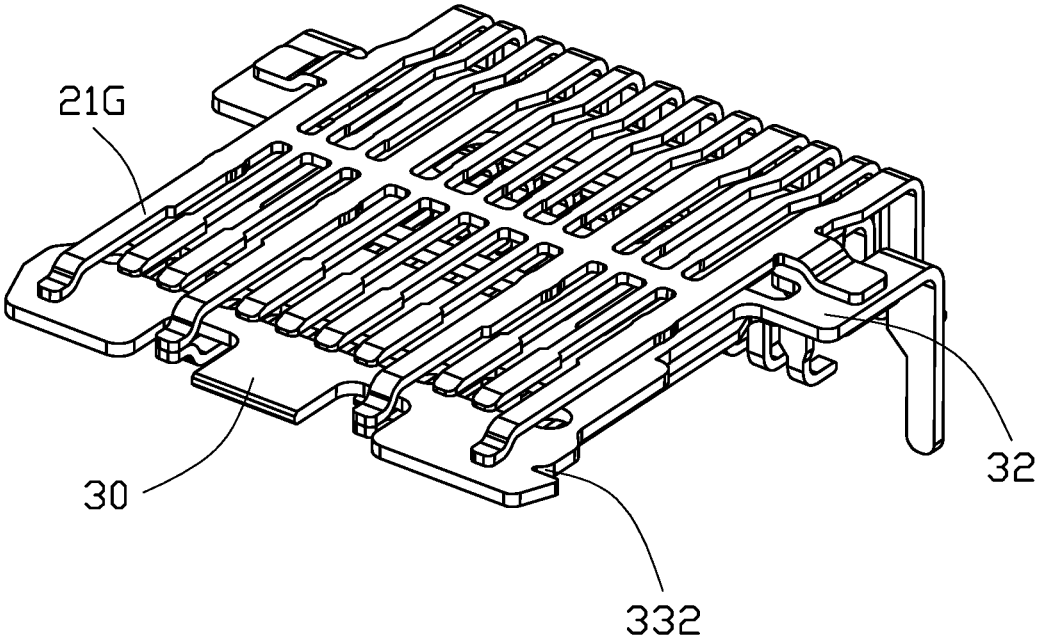
FIG. 20 is a perspective view of the terminals and the shielding plate as shown in FIG. 19.
Figure 21:
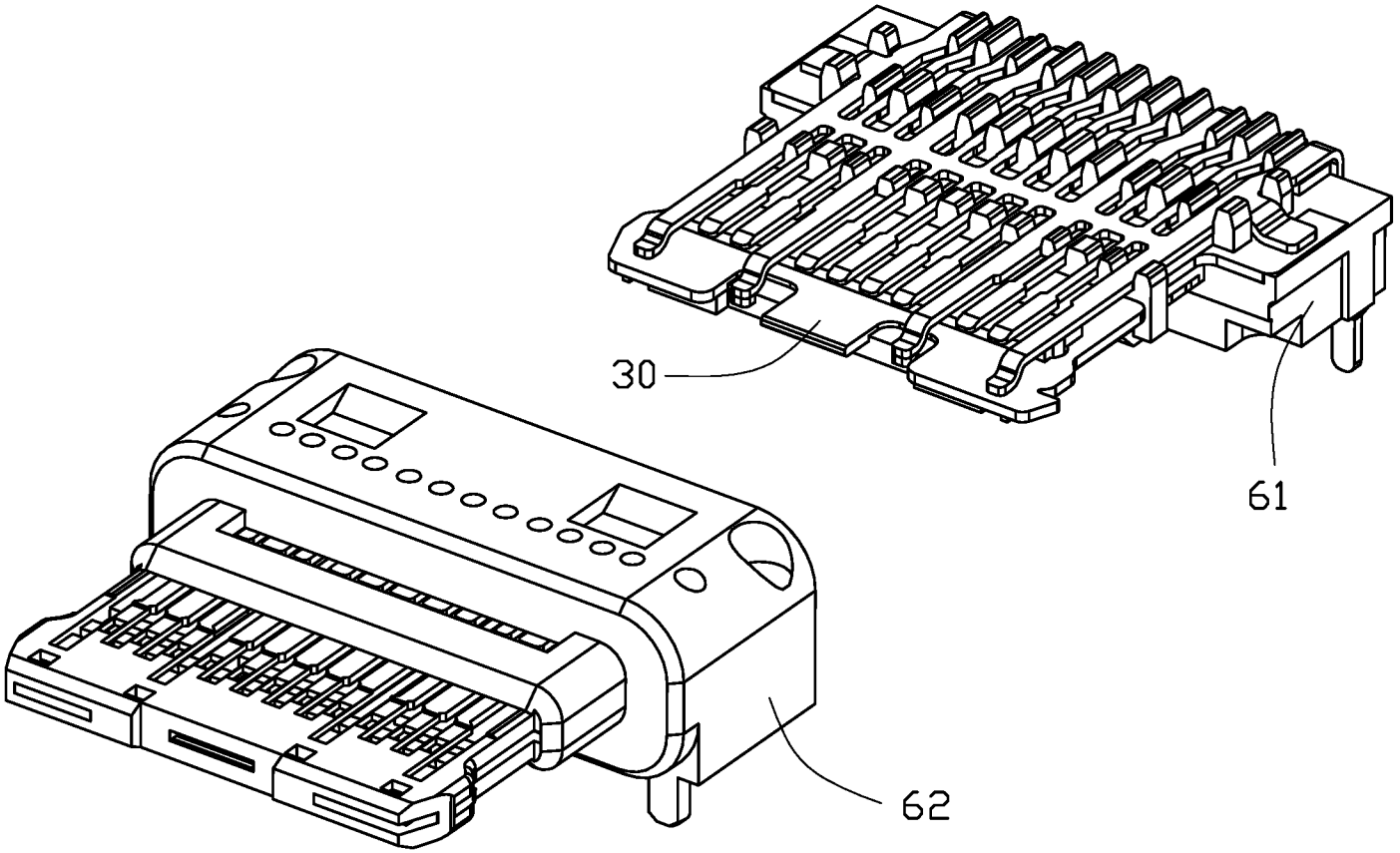
FIG. 21 is an exploded perspective view of the electrical connector as shown in FIG. 19.
Figure 22:
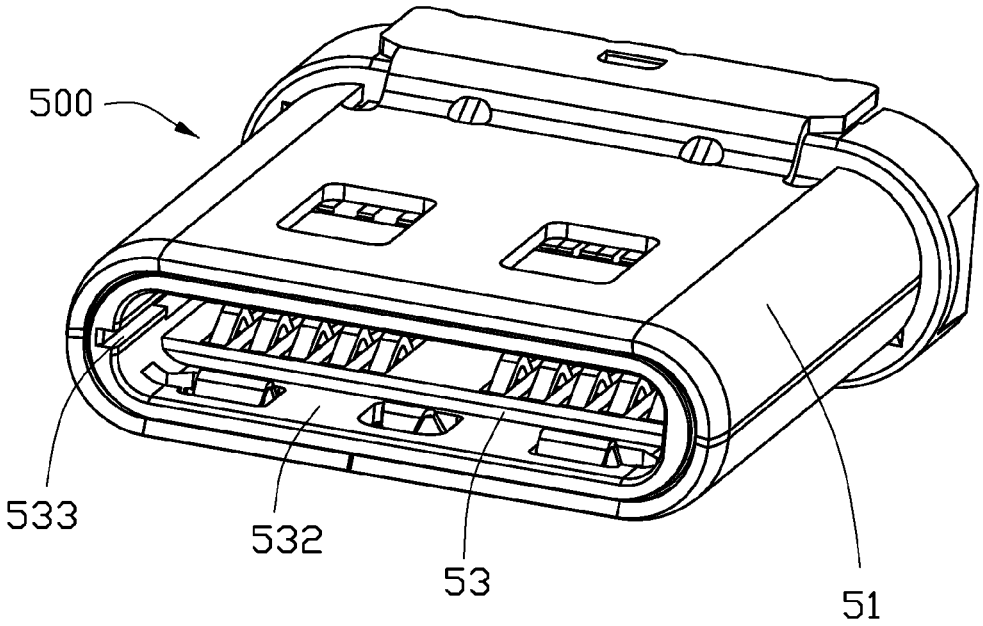
FIG. 22 is a front perspective view of the plug connector as shown in FIG. 17.
Figure 24:
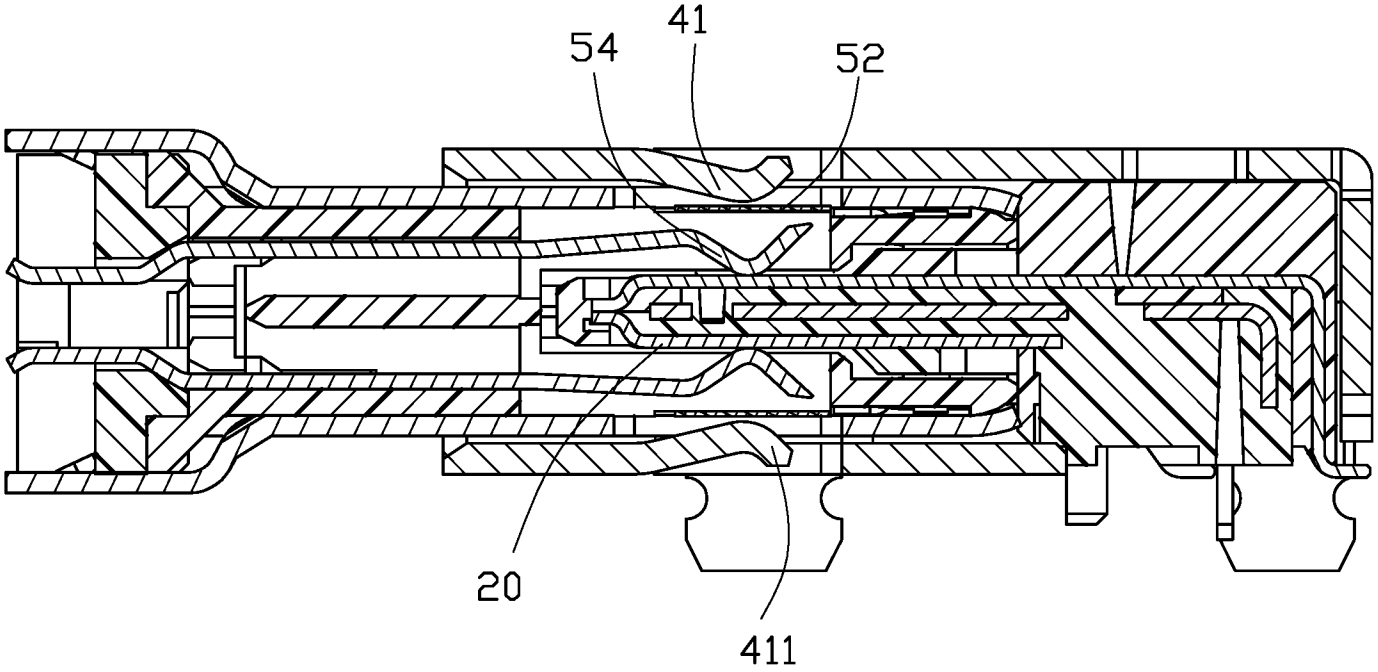
FIG. 24 is a cross-section view of the mating receptacle connector and plug connector as shown in FIG. 17.

A best shown in FIG. 17 and FIG. 24, the shielding shell 40 of the receptacle connector 30 defines two spring arm 41 with an arc free end 411 thereof, on each sidewall thereof. The arc free end 411 has an angle larger than 20 degrees compared with the upper surface of the mating tongue. The shielding shell 50 of the plug connector 500 defines an open 511 for the spring arm 41 and an insulating film 52 are affix to an insulating base 53 and aligned with the opening 511. Therefore the spring arms 41 do not touch the terminals 54 in the insulating base 53. The shielding shell further includes tabs 42 pressing against recesses 112 defined on the base portion 11 thereof.

The shielding plate 30 is embedded in the mating tongue 12 and the base 11 of the insulating housing 10. The mating tongue 12 defines opposite mating surface 13*a* and opposite end surfaces 13*b* and front face 13*c*. The shielding plate 30 have a pair of protruding locking portions 311 exposed to the end surfaces 13*b* of corresponding mating tongue 12, which is used to lock with a pair side latches on the plug connector.

The feature of the receptacle connector 300 is that the shielding plate 30 further extends a protrusion 33 in front of the locking portion 311 and beyond the end surfaces 13*b* of the mating tongue 12. The protrusion 33 has a slot 332 between the locking portion 311. The insulating base 53 of the plug connector 500 defines a receiving cavity 532 surrounding by walls to receive the mating tongue 12 of the receptacle connector 300. Each inner side of end walls of the insulating base 53 defines a slot 533 running forwardly. The protrusion 33 is inserted into the slot 533 when the plug connector 500 is inserted in the receptacle connector 300. The form factor of this customized receptacle 300 and plug connector 500 is similar to the standard USB Type C connector, for example the receptacle connector 200 in the second embodiment. The customized connector do not transmit USB Type C signal and is used to transmit PCI-e signal as labeled in FIG. 23. In conclusion, the protrusion 33 of the receptacle connector can prevent from insertion with a standard plug connector.

Figure 25:
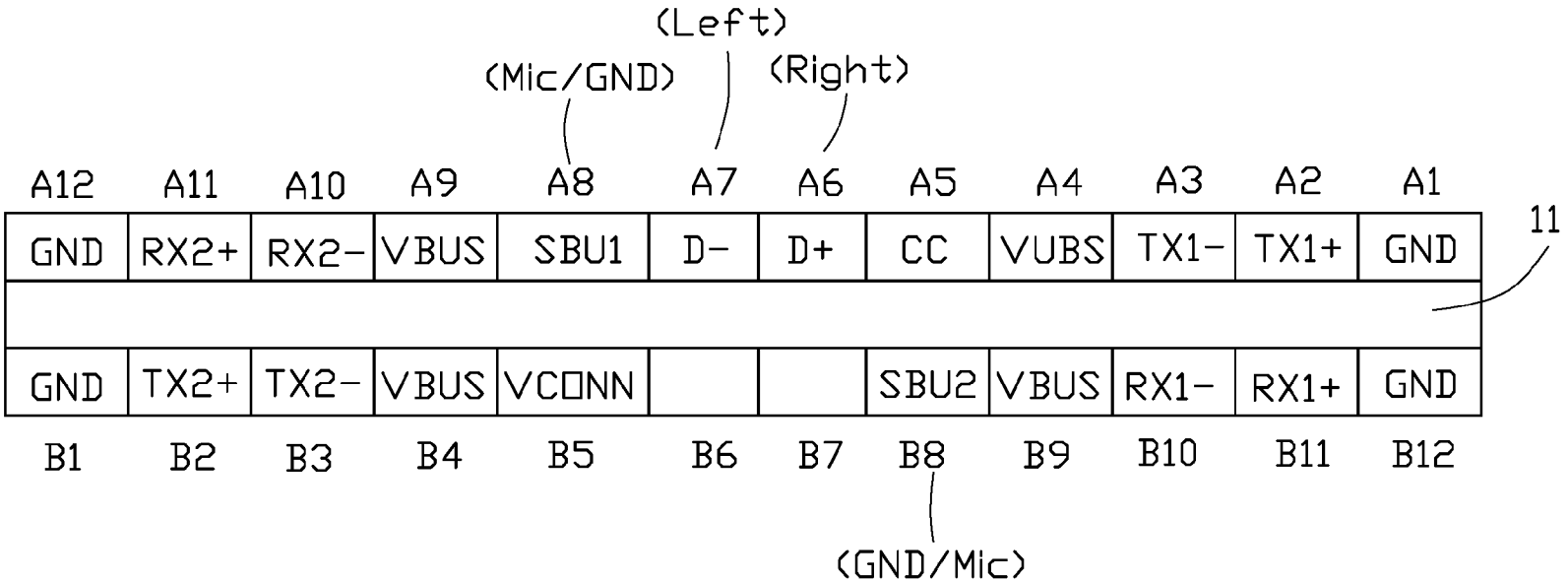
FIG. 25 is a table shown terminals' assignment of a plug connector of a fourth embodiment made in accordance with the present invention.
Figure 26:
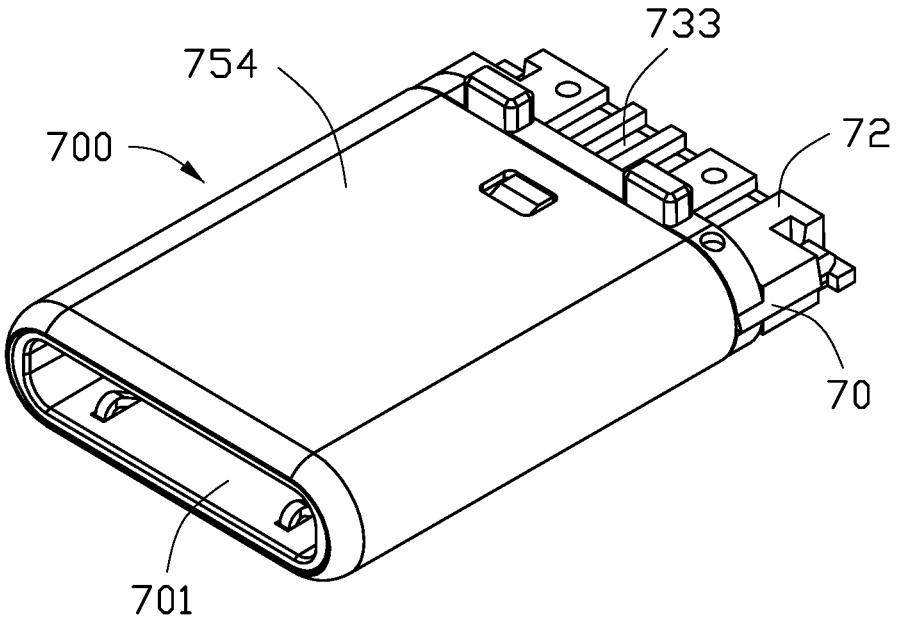
FIG. 26 is a front and top perspective view of the plug connector of the fourth embodiment.
Figure 27:
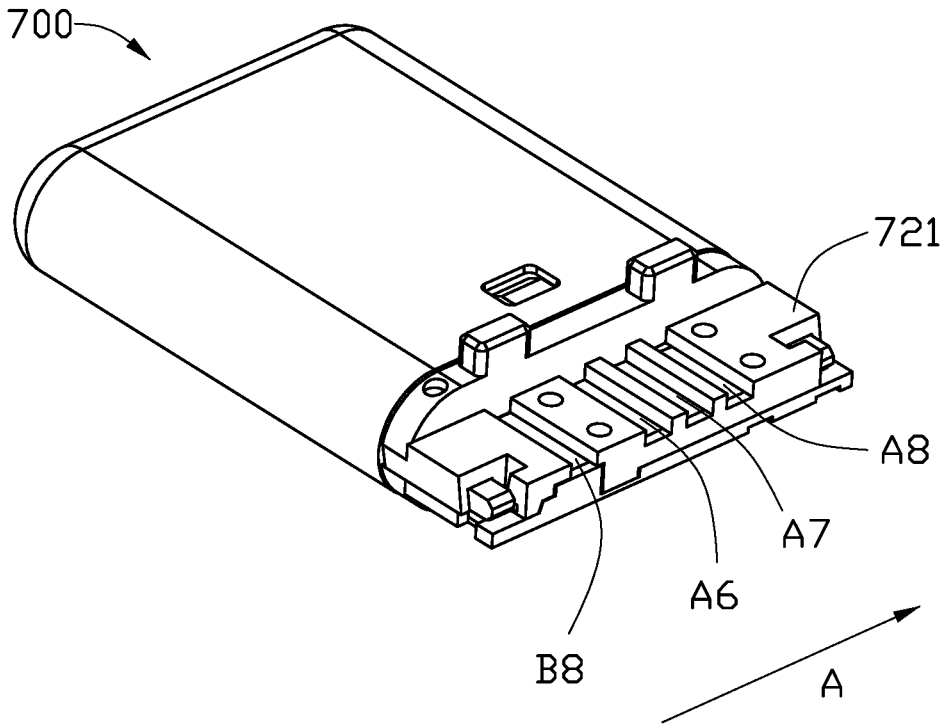
FIG. 27 is a top and rear perspective view of the plug connector as shown in FIG. 26.
Figure 28:
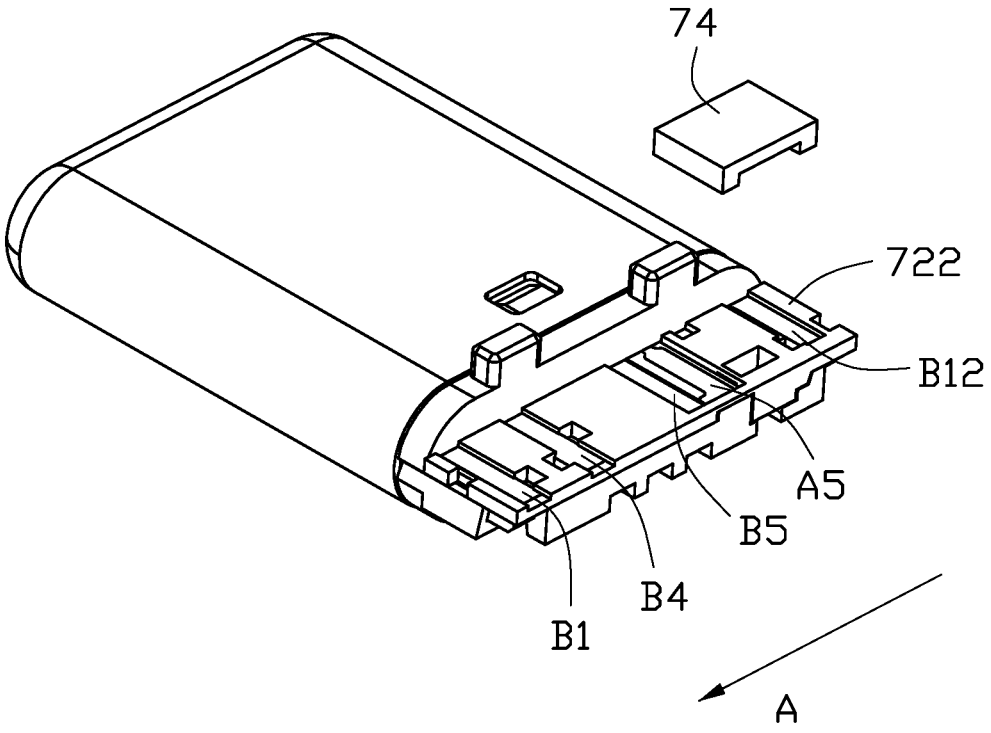
FIG. 28 is a bottom and rear perspective view of the plug connector as shown in FIG. 26.
Figure 29:
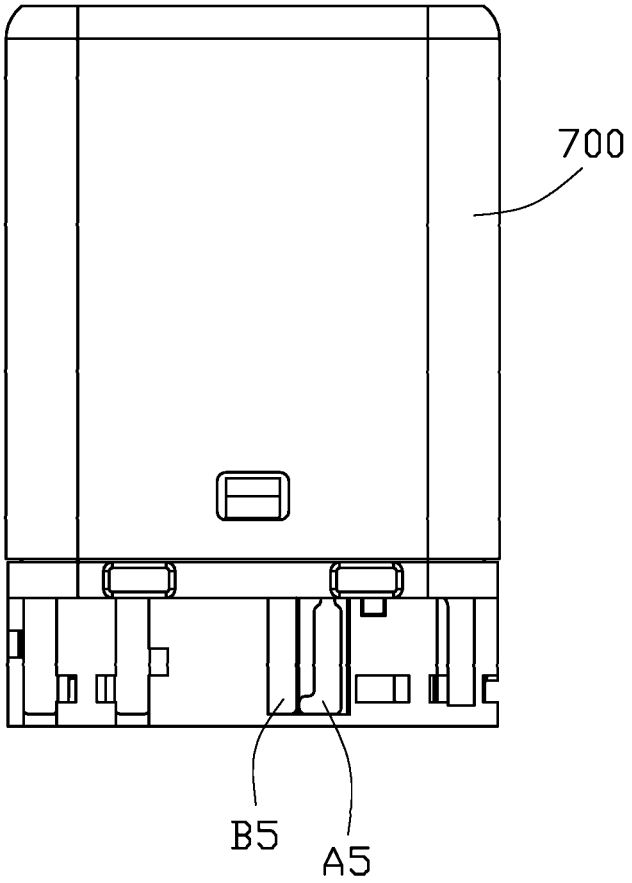
FIG. 29 is a top plane view of the plug connector as shown in FIG. 28.

FIG. 25 shows the USB Type C analog audio pin assignment defined in USB Type C specification which is named as the audio Adaptor Accessory Mode on USB Type C. The terminals of the plug connector are defined as A1 through A12 on a first row and B12 through B12 on a second row front a same side. The first and second rows of terminals are aligned with each other along a vertical direction. In a standard connector, the terminals A6, A7 are defined to transmit USB 2.0 signal, terminals A8, B8 are remained for customer definition. In this audio plug connector, the terminal A6, A7 are used to transmit right and left audio signal of the ear phone, A8, B8 are used to transmit MIC and GND of ear phone. The plug connector 700 meeting said function will be described hereafter.

Figure 32:
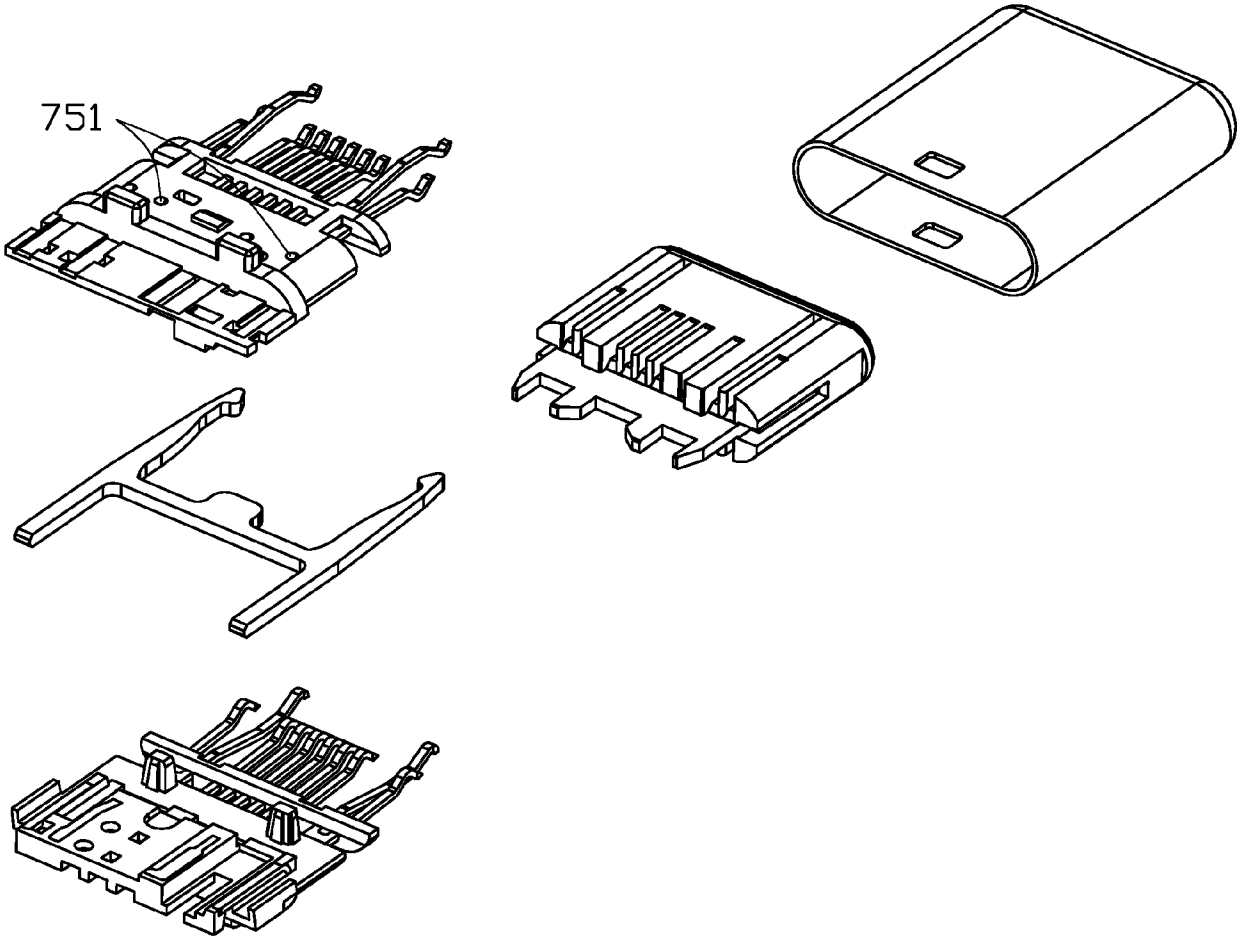
FIG. 32 is a rear exploded view of the plug connector as shown in FIG. 26.
Figure 33:
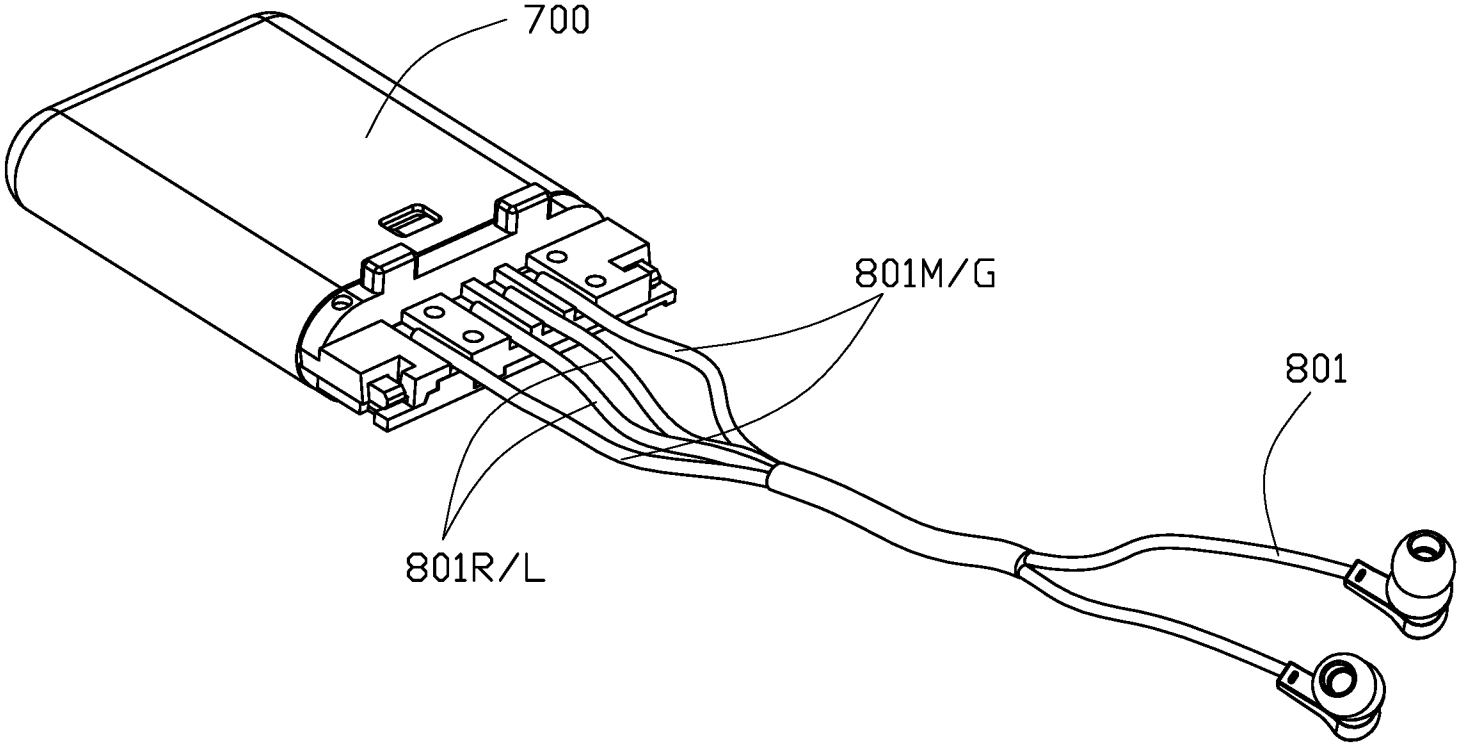
FIG. 33 is a perspective view of the plug connecting connected with an earphone.
Figure 34:
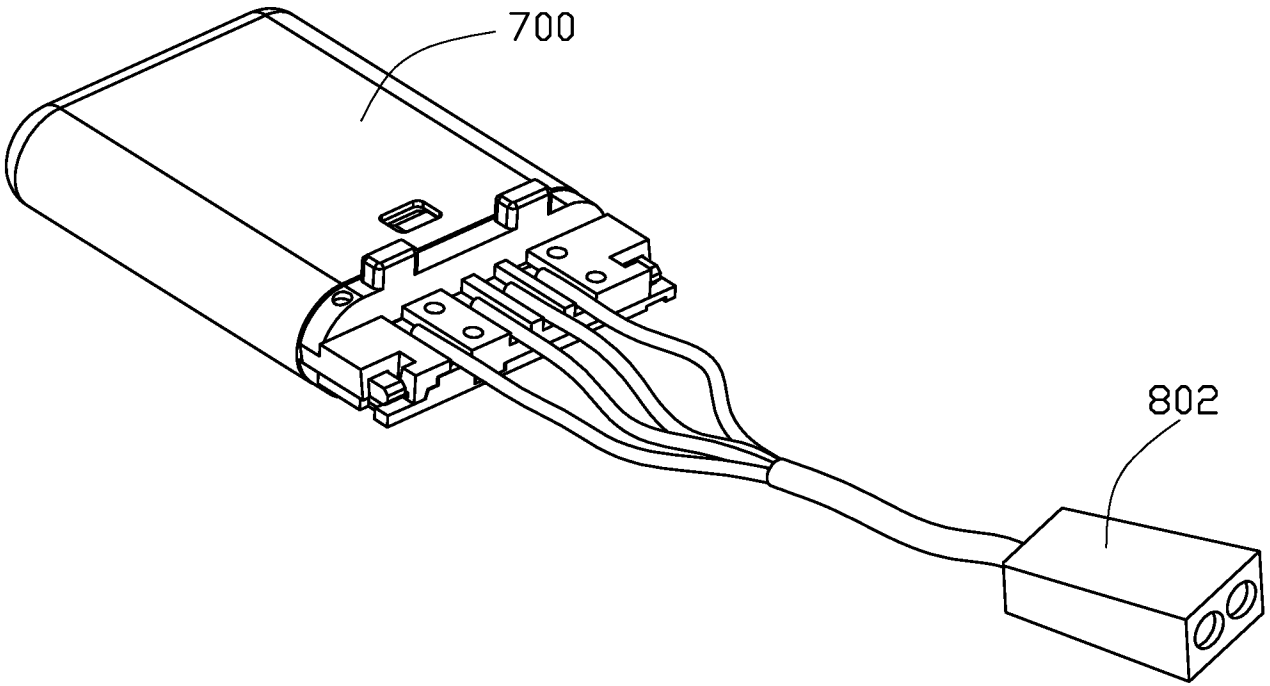
FIG. 34 is a perspective view of the plug connecting connected with an earphone adaptor.
Figure 35:
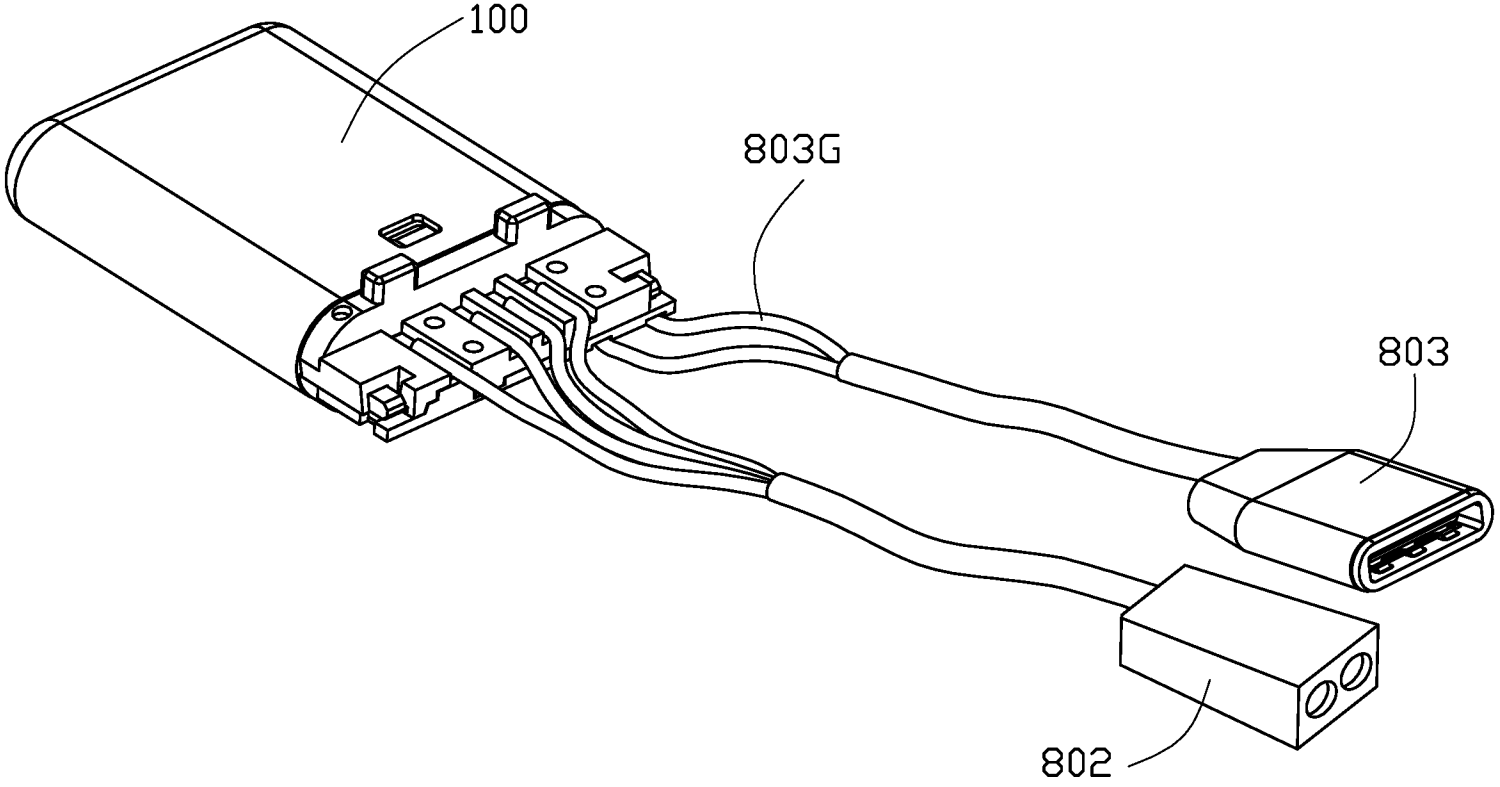
FIG. 35 is a perspective view of the plug connecting connected with a power cable.

Referring to FIG. 26 to FIG. 35, a plug connector 700 of the fourth embodiment which can be used to be soldered with different types cables as best shown in FIGS. 34-35, such as connecting with an ear phone cable 801, or an ear phone adaptor 802, or a power cable 803.

The plug connector 700 includes an insulating base 70 with a receiving cavity 701 and the contacting sections of the two rows of terminals are arranged on the vertical inner sides of the receiving cavity 701. The insulating base 70 includes a rear cable platform 72, and the soldering portions 733 of the terminals are exposed to the rear cable platform 72. The platform 72 defines a first surface 721 and a second surface 722 opposite to the first surface. The first surface 721 of the platform are exposed with soldering portions 733 of terminal B8, A6, A7, A8, the second surface 722 of the platform are exposed with the soldering portions 733 of terminals A5, B5, B4, B1.

Figure 30:
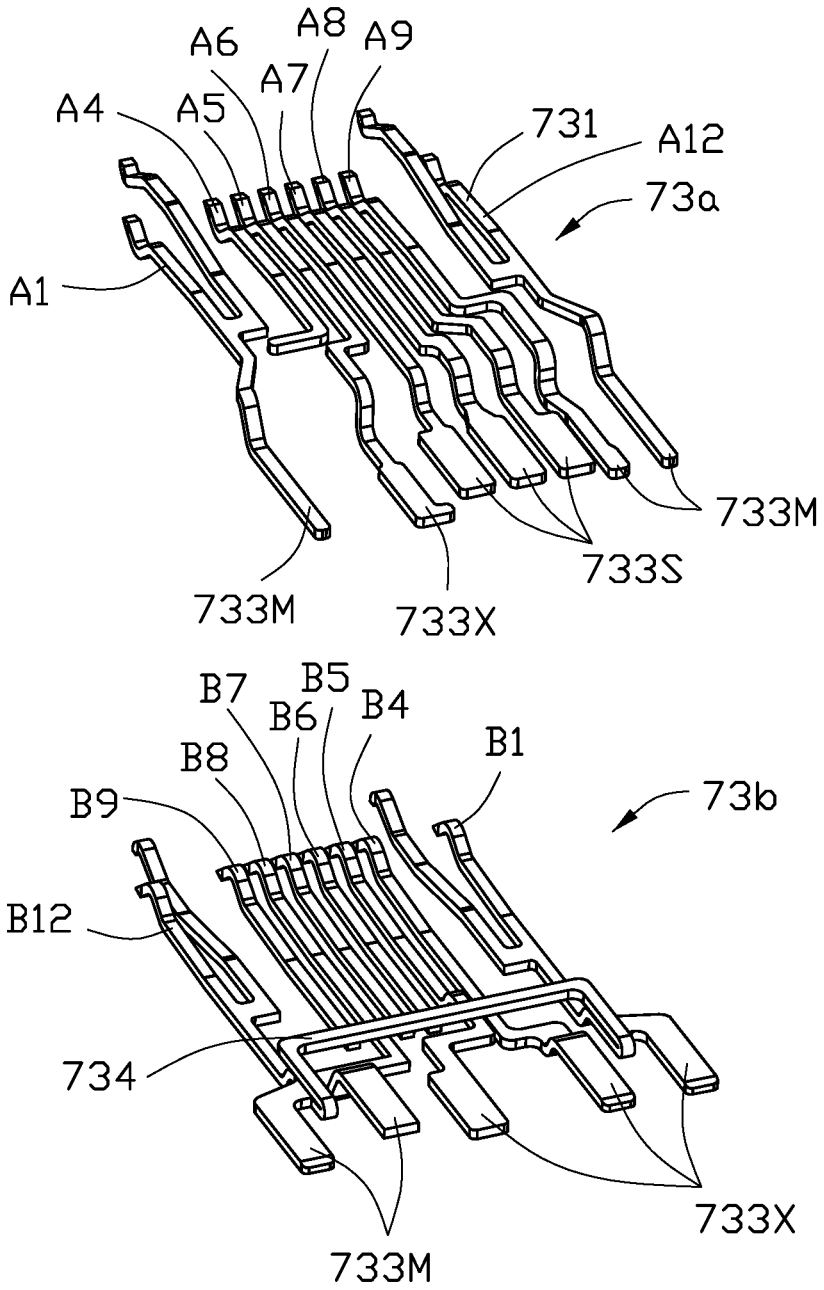
FIG. 30 is an exploded view of two rows of terminals.
Figure 31:
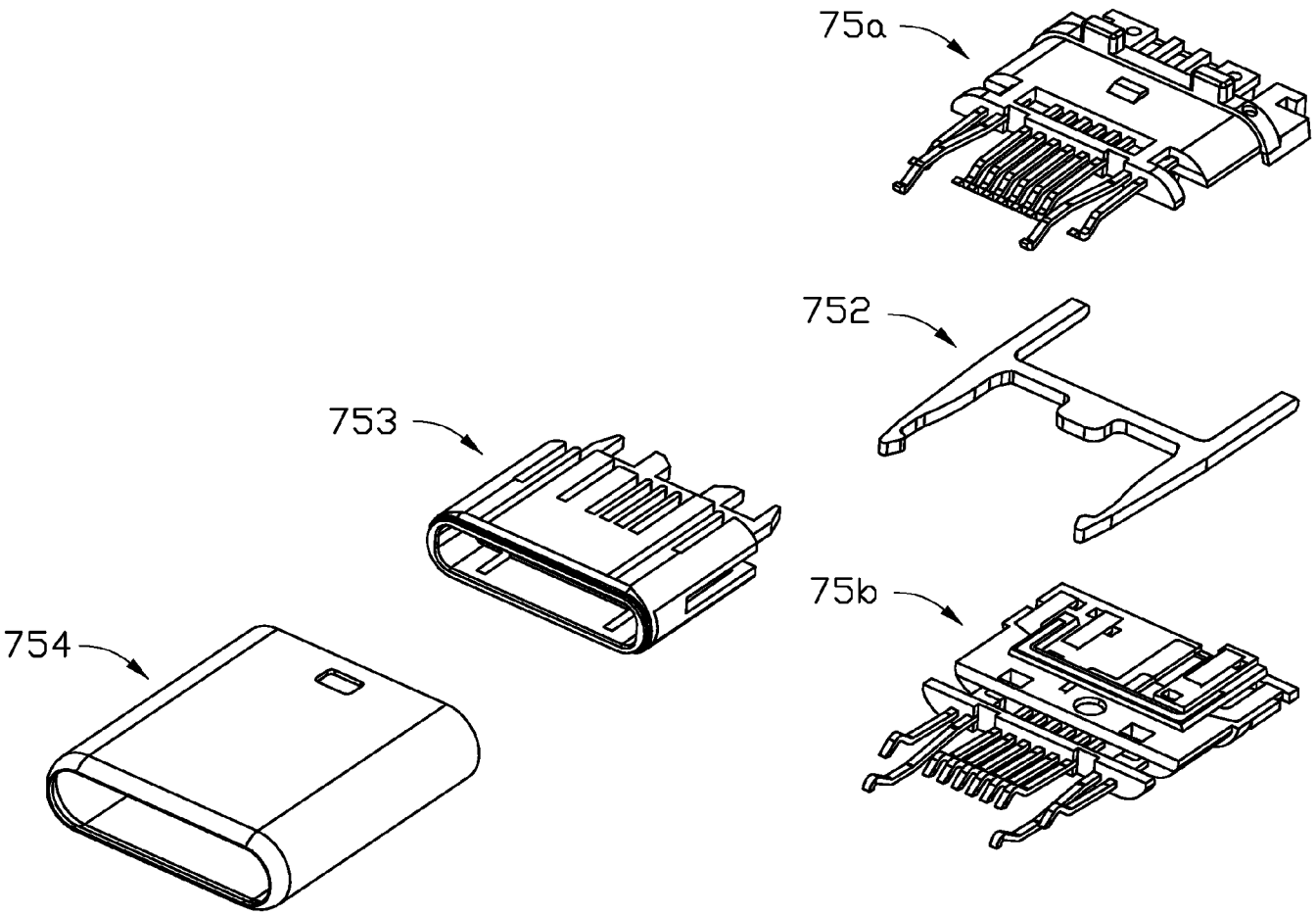
FIG. 31 is a front exploded view of the plug connector as shown in FIG. 26.

Referring to FIG. 30 to FIG. 32, the contacting portions 731 of the upper row terminals 73*a* which include terminals A1, A5, A6, A7, A8, A9, A12, the leg portions 733S of terminals A6, A7, A8 are located at an upper row so that those three leg portions 733S are exposed to the first surface 721 of the platform and functioned as said soldering sections. Leg portions 733M of terminal A1, A9, A12 are located in a middle level so that those leg portions are embedded in the platform 72. Leg portion 733X of the terminal A5 are located in a lower level so that the leg portion 733*x* are exposed to the lower surface 722 of the platform and functioned as one soldering section. The contacting portions of the lower row terminals 73*b* which include terminals B12, B9, B8, B7, B6, B5, B4, B1. The leg portions 733X of the terminals B5, B4, B1 are located in the lower level and exposed to the second surface together with soldering sections 733X of the terminal A5. The soldering sections 733X of the terminal A5 are located between the soldering sections of the terminals B5, B4. The leg sections 733M of the terminals B12, B8 are located in the middle level and embedded within the cable platform 720.

The terminals B12, B1 are transversely connected with each other by an folded U shaped bridge 734. The leg portions of the upper and lower grounding/power terminals are stacked with each other.

The plug connector includes an upper module 75*a* with the row of upper terminals 73*a* and a lower module 75*b* with the row of lower terminals 73*b* sandwiched with an H-shaped side latch 752, and an front housing 753 inserted with said upper and lower module, and a shielding shell 754 fitly surrounding the insulating base. The module 75*a*, 75*b* defines slit 751 for filled with insulative material.

As best shown in FIG. 33, the plug connector 700 is connected with an ear phone 801 having four wires, a left and right audio wires 801L/R, a microphone wire and a grounding wire 801M/G. The four wires are soldered with the soldering portions of terminals B8, A6, A7, A8 in sequence, respectively, and the soldering portions in the second surface are unused. Combination with FIG. 28, the soldering portions of the terminals B5, A5 are welded with a SMT type resistor 740 having 10,000 ohm a.

As best shown in FIG. 34, the plug connector 700 is connected with an ear phone adaptor 802 which also have four wires similar to that shown in FIG. 33. The adaptor 802 is only soldered to the soldered portions on the first surface. The soldering portions of the terminals B5, A5 are welded with a SMT type resistor 740.

As best shown in FIG. 35, the plug connector 700 is connected with an ear phone adaptor 802 which also have four wires same to that shown in FIG. 33 and a power plug 803 which has a grounding wire 803G and a power wire. The four wires of the adaptor 802 are welded with soldered portions on the first surface and the two wires of the power cable are welded with the soldering portions of the terminals B1, B4, and the soldering portions of the terminals B5, A5 are welded with a SMT type resistor 740.

However, the disclosure is illustrative only, changes may be made in detail, especially in matter of shape, size, and arrangement of parts within the principles of the invention. Understandably, as mentioned before, the spirit of the invention throughout all embodiments is to provide the sandwiched type terminal assembly, i.e., the upper terminal module and the lower terminal module commonly sandwiching the shielding plate module which may include the shielding plate only or further with the insert-molded insulator, wherein the front edge and the lateral edges of the shielding plate are exposed to an exterior and optionally equipped with notches for locking. On the other hand, because all the embodiment essentially share the similar structures, some specific structures not clearly shown in one embodiment may be clearly shown in other embodiments for examination purpose.

What is claimed is:

1. An electrical connector assembly comprising:

an electrical connector comprising a row of upper terminals and a row of lower terminals, each terminal comprising a pin leg section;

a printed circuit board (PCB) defining a top surface on which the electrical connector is mounted and a lower surface, and comprising a row of first holes to receive the pin leg sections of the upper terminals and a row of second holes to receive the pin leg sections of lower terminals along a front and back direction, the corresponding first and second holes being aligned with each other in the front and rear direction;

each row of the first and second holes consisting of a grounding hole, a power hole, four signal holes, a power hole, and a grounding hole in sequence;

wherein each of first holes further is connecting with an extending trace on the top surface to a system, each of the grounding holes and power holes of the first holes are further connected with corresponding the corresponding hole of the second holes with a connecting trace on the top surface;

wherein a first signal hole and a fourth signal hole of the second holes each is connected with an extending trace on the lower surface to the system with any connecting traces therebetween;

wherein a second signal hole of the first holes further is connected with the a third signal holes of the second holes with a connecting trace on one of the top and lower surface, a third signal holes of the first holes further is connected with a second signal holes of the second hole with a connecting trace on another of the top and lower surface.

2. The electrical connector assembly as claimed in claim 1, wherein the connecting trace between the second signal holes of the first holes and the third signal holes is located on the top surface of the PCB, the connecting signal trace between the third signal holes of the first holes and the second signal holes is located at the lower surface of the PCB.

3. The electrical connector assembly as claimed in claim 1, wherein all of the first holes and the second holes have a same distance between every adjacent two holes.

4. An electrical connector assembly comprising:

a housing comprising a rear base and a mating tongue extending forward from the base;

a row of upper terminals and a row of lower terminals retained on the housing, each terminal comprising a contacting section exposed to mating tongue and a pin leg section from the base, and the contacting sections of the upper and lower terminals being aligned with each in a vertical direction; wherein the contacting sections of each row terminals are arranged in different central pitch, the pin leg sections of the upper and lower terminals are aligned with each in a front and back direction and the pin leg sections of each row are arranged with a same central pitch;

wherein each row of terminals consists of a grounding terminal, a power terminal, four signal terminals, a power terminal and a grounding terminal in sequence without a pair of differential pair terminals between the adjacent grounding terminal and power terminals, every adjacent two of the power terminal and fourth the signal terminal has a first central pitch, the adjacent grounding terminal and power terminal has triple first central pitch;

wherein every adjacent leg sections has a second central pitch, which is thicker than the first central pitch;

wherein a shielding plate is disposed between the upper and lower terminals.

5. The electrical connector assembly as claimed in claim 4, wherein the base defines a slot through a top and lower surface thereof, each of upper terminals has a wing section exposed to the slot.

6. An electrical connector comprising;

an housing comprising a rear base and a mating tongue extending forward from the base;

a row of upper terminals and a row of lower terminals retained on the housing, each terminal comprising a contacting section exposed to mating tongue, a middle portion and a leg section from the base;

leg sections of the upper terminal comprising vertical connecting portions and horizontal soldering pads bending from the vertical connecting portion, All the leg portions being arranged in a straight line pad row;

wherein the row of lower terminals are divided to three types of the leg portions, the leg portions of a first type are in a vertical pin shape and arranged in a front row; the leg sections of a second type are in a vertical pin shape and are arranged in a middle row behind the front row and in front of the soldering row; the leg sections of a third type are constructed with a vertical portion, a horizontal portion bending from the vertical portion and a vertical soldering portion bending from the horizontal portion; the vertical portion are disposed in the front row, the vertical soldering portion are disposed in the middle row.

7. The electrical connector as claimed in claim 6, wherein a shielding plate is disposed between the upper and lower terminals and have opposite side latches.

* * * * *